US010004307B2

(12) United States Patent
Chi Yueh Chen et al.

(10) Patent No.: US 10,004,307 B2
(45) Date of Patent: Jun. 26, 2018

(54) FOLDING DUFFLE

(71) Applicant: Biaggi USA, LLC a Delaware Limited-Liability Company, Woodmere, NY (US)

(72) Inventors: Stephen Chi Yueh Chen, Arcadia, CA (US); Ahron Hersh, Brooklyn, NY (US); Nancy Mei-Hui Hung, Shilin District (TW)

(73) Assignee: Biaggi USA, LLC a Delaware Limited-Liability Company, Woodmere, NY (US)

( * ) Notice: Subject to any disclaimer, the term of this patent is extended or adjusted under 35 U.S.C. 154(b) by 0 days. days.

(21) Appl. No.: 14/410,436

(22) PCT Filed: Jun. 21, 2013

(86) PCT No.: PCT/US2013/047191

§ 371 (c)(1),
(2) Date: Dec. 22, 2014

(87) PCT Pub. No.: WO2013/192595

PCT Pub. Date: Dec. 27, 2013

(65) Prior Publication Data

US 2015/0320165 A1 Nov. 12, 2015

Related U.S. Application Data

(63) Continuation-in-part of application No. 13/594,010, filed on Aug. 24, 2012, now Pat. No. 9,375,063, and
(Continued)

(51) Int. Cl.

| | |
|---|---|
| ***A45C 5/14*** | (2006.01) |
| ***A45C 7/00*** | (2006.01) |
| ***A45C 5/04*** | (2006.01) |

(52) U.S. Cl.

CPC ..... *A45C 7/0054* (2013.01); *A45C 5/04* (2013.01); *A45C 7/0022* (2013.01);
(Continued)

(58) Field of Classification Search

CPC ... A45C 7/0036; A45C 2009/007; A45C 5/14; A45C 13/1046; A45C 7/0059; A45C 7/0063
(Continued)

(56) References Cited

U.S. PATENT DOCUMENTS

| | | | | |
|---|---|---|---|---|
| 3,362,041 A | | 1/1968 | Fynewever | |
| 4,090,593 A | * | 5/1978 | Koff ..... | A45C 7/0063 190/103 |

(Continued)

FOREIGN PATENT DOCUMENTS

| | | |
|---|---|---|
| EP | 0662289 B1 | 4/2001 |
| JP | 2002-051818 A | 2/2002 |

(Continued)

OTHER PUBLICATIONS

International Preliminary Report on Patentability dated Dec. 23, 2014, in related International Application No. PCT/US2013/047191, 7 pages.

*Primary Examiner* — Sue A Weaver
(74) *Attorney, Agent, or Firm* — Schwabe, Williamson & Wyatt, P.C.; Aaron Haleva

(57) ABSTRACT

In exemplary embodiments of the present invention, systems and methods for providing foldable duffle bags are presented. Such exemplary collapsible duffles can have two states: (i) a fully extended state in which said luggage is used by a user to hold, for example, clothing and objects, and its wheels fully extended and usable, and (ii) a compressed or folded state in which the luggage has a minimum volume and can be easily and conveniently stored and carried, especially where space is a premium, where the wheels are invisible and out of the way. Various novel technologies are used to obtain maximal compression in the compressed state, and to allow for convenient transformation between the two states. Exemplary duffles of rather significant fully
(Continued)

expanded size can be rolled or folded onto themselves, the wheels can be turned inside out, and the article compressed into a small hand held carrying case.

12 Claims, 58 Drawing Sheets

Related U.S. Application Data a continuation-in-part of application No. 13/594,093, filed on Aug. 24, 2012.

(60) Provisional application No. 61/690,234, filed on Jun. 21, 2012, provisional application No. 61/690,197, filed on Jun. 21, 2012, provisional application No. 61/690,233, filed on Jun. 21, 2012.

(52) U.S. Cl.
CPC ..... *A45C 7/0077* (2013.01); *A45C 5/14* (2013.01); *A45C 7/0036* (2013.01); *Y10T 16/5406* (2015.01); *Y10T 16/540257* (2015.01)

(58) Field of Classification Search
USPC ..... 190/103, 197, 107, 18 A; 220/6, 666; 280/DIG. 3; 383/2
See application file for complete search history.

(56) References Cited

U.S. PATENT DOCUMENTS

| | | | | |
|---|---|---|---|---|
| 4,974,870 | A | 12/1990 | Jarke et al. | |
| 5,197,580 | A | 3/1993 | Berman et al. | |
| 5,307,908 | A | 5/1994 | Shyr et al. | |
| 5,505,297 | A * | 4/1996 | Myers | A45C 3/004 190/125 |
| 5,653,337 | A * | 8/1997 | Cirigliano | A45C 3/00 206/373 |
| 6,182,981 | B1 | 2/2001 | Kuo | |
| 6,227,339 | B1 | 5/2001 | Bogert | |
| 6,401,890 | B1 * | 6/2002 | Tan | A45C 5/14 150/159 |
| 6,443,274 | B1 | 9/2002 | Klamm | |
| 6,604,617 | B2 | 8/2003 | Davis et al. | |
| 6,926,129 | B2 | 8/2005 | Hoberman | |
| 7,232,018 | B1 | 6/2007 | Salander | |
| 7,500,547 | B2 | 3/2009 | Bettua et al. | |
| 2004/0000457 | A1 | 1/2004 | Sanford-Schwentke | |
| 2005/0284718 | A1 * | 12/2005 | Tai | A45C 7/0077 190/107 |
| 2006/0118376 | A1 | 6/2006 | Godshaw et al. | |
| 2007/0038162 | A1 | 2/2007 | Alexiadis | |
| 2010/0300825 | A1 | 12/2010 | Nordstrom | |
| 2011/0168506 | A1 * | 7/2011 | Santy | A45C 3/001 190/125 |
| 2013/0140120 | A1 * | 6/2013 | Rasmussen | A45C 7/009 190/109 |

FOREIGN PATENT DOCUMENTS

| | | | |
|---|---|---|---|
| JP | 2007-037755 | A | 2/2007 |
| KR | 20-0460256 | | 5/2012 |
| WO | 1998/12943 | A1 | 4/1998 |
| WO | 2002/052975 | A1 | 7/2002 |
| WO | 2008/021793 | A2 | 2/2008 |
| WO | 2010/141207 | A1 | 12/2010 |

* cited by examiner

FRONT VIEW 1410

BACK VIEW 1420

FOLDING DUFFLE

CROSS-REFERENCE TO RELATED APPLICATIONS

The present application claims the benefit of U.S. Provisional Patent Application Nos. 61/690,234, filed on Jun. 21, 2012, 61/690,197, filed on Jun. 21, 2012, and 61/690,233, filed on Jun. 21, 2012, each of which is hereby incorporated herein by reference. The present application also claims the benefit of U.S. patent application Ser. No. 13/594,010, filed on Aug. 24, 2012, and Ser. No. 13/594,093, filed on Aug. 24, 2012, each of which is hereby incorporated herein by reference.

TECHNICAL FIELD

The present invention relates to luggage technologies, and in particular to systems and methods for providing various foldable/collapsible duffle bags, sacks or the like that can have significant volume in an expanded state, and also achieve significant compression of volume, and ease of portability, in a compressed state.

BACKGROUND OF THE INVENTION

In the modern world, especially in areas which are substantially populated, people live in relatively small apartments or even houses and have a limit on storage space. Often, when storing luggage, a large amount of space or an entire closet is devoted to the task. This is because luggage doesn't readily stack on each other and doesn't have a uniform size so there are loose piles of luggage which often are somewhat unstable and fall over. Additionally, in order to save space when transporting luggage, such as from a manufacturer in the Orient to an American distributor, luggage cannot readily be compressed so sets of luggage are attempted to be nested one within the other, biggest piece then medium piece then smallest piece which creates a lot of work on the receiving end to take them apart. Finally, when marketing luggage at the retail level, there is generally not enough store space to display all the various pieces that a particular store might have so they display two or three different sets and then the sales person has to go into the back room and bring out the luggage or the set of luggage when you actually purchase it.

All of these inconvenient aspects of owning, shipping and marketing luggage could be ameliorated if luggage could be compressed when not being used and such compressed state of the luggage could be in a uniform size.

What is needed in the art is a convenient and elegant method for compressing duffle bags that solves some of the problems described above.

SUMMARY OF THE INVENTION

In exemplary embodiments of the present invention, systems and methods for providing foldable duffle bags are presented. Such exemplary collapsible duffles can have two states: (i) a fully extended state in which said luggage is used by a user to hold, for example, clothing and objects, and its wheels fully extended and usable, and (ii) a compressed or folded state in which the luggage has a minimum volume and can be easily and conveniently stored and carried, especially where space is a premium, where the wheels are invisible and out of the way. Various novel technologies are used to obtain maximal compression in the compressed state, and to allow for convenient transformation between the two states. Exemplary duffles of rather significant fully expanded size can be rolled or folded onto themselves, the wheels can be turned inside out, and the article compressed into a small hand held carrying case.

DETAILED DESCRIPTION OF THE INVENTION

In exemplary embodiments of the present invention, systems and methods for providing foldable duffle bags are presented. Such exemplary collapsible duffles can have two states: (i) a fully extended state in which said luggage is used by a user to hold, for example, clothing and objects, and its wheels fully extended and usable, and (ii) a compressed or folded state in which the luggage has a minimum volume and can be easily and conveniently stored and carried, especially where space is a premium, where the wheels are invisible and out of the way. Various novel technologies are used to obtain maximal compression in the compressed state, and to allow for convenient transformation between the two states. Where less rigidity is required, duffles of rather significant fully expanded size with four wheels can be rolled or folded onto themselves and compressed into a small hand held carrying case that looks like a laptop computer case.

In exemplary embodiments of the present invention various folding or duffle bags can be provided that compress into a rather small footprint and can be easily transported. It is often noted that when people go on vacation they often come back with much more clothing, presents, gifts and other goods and merchandise than they left with. This is due to the fact that people often go to destinations which are known for their shopping, such as, for example, Hong Kong, Tokyo, Paris, etc., and while in such a destination they feel the desire to purchase many articles. These can include, for example, clothing, shoes, electronics, luggage, trinkets and souvenirs, etc. For these reasons people often purchase a piece of luggage while they are there and fill it with some of their purchases and bring it home.

In exemplary embodiments of the present invention this is no longer necessary, inasmuch as a vacationer can bring a collapsible duffle bag either in its own collapsed state or placed inside one of the user's other articles of full-size luggage. Exemplary small footprint foldable duffle bags as described below expand to a rather large full size, and have wheels in such expanded configuration, thus satisfying all a user's needs for an additional article of luggage. The present invention is directed to various embodiments of such folding foldable duffle bags, as next described.

Figure 1:
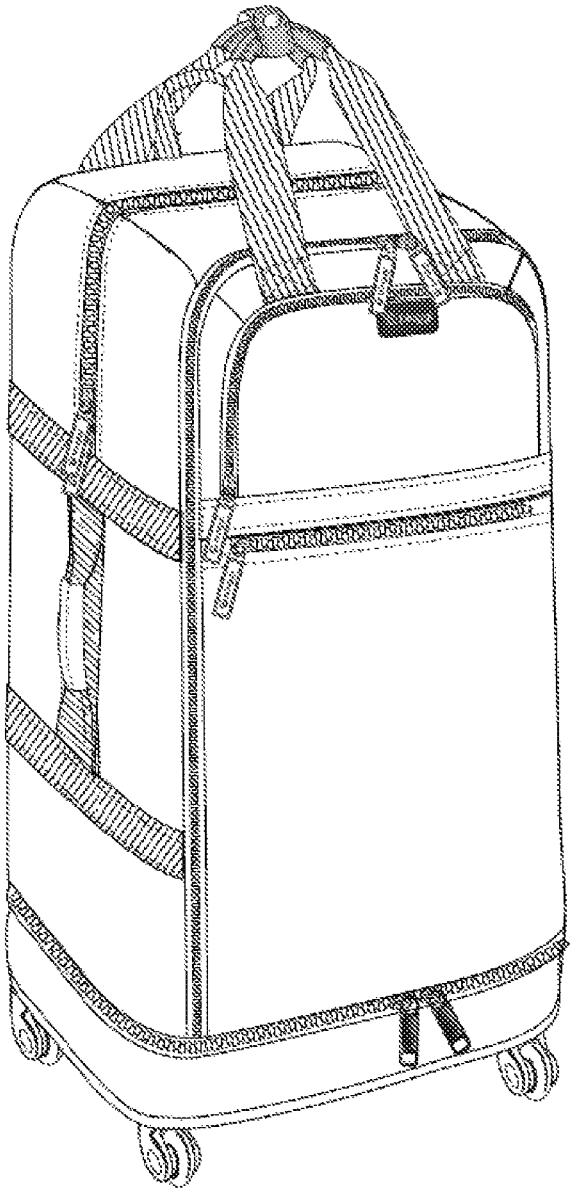
FIG. 1 depicts an exemplary foldable duffle according to exemplary embodiments of the present invention.

FIGS. 1-14, next described, illustrate two basic types of 4-wheel folding duffles according to exemplary embodiments of the present invention. As noted above, FIGS. 1-9 illustrate a first type of foldable duffle according to exemplary embodiments of the present invention. With reference to FIG. 1, there is seen a foldable duffle arranged to be primarily held by a user at the top, where the duffle is oriented vertically. As also can be seen in FIG. 1, there is a handle for holding the duffle in its full extension horizontally; however the easiest way to maneuver the piece is by rolling it on its four wheels in the vertical configuration and holding it at the top. As can also be seen, there is a front pocket, a zippered upper front flap, and the upper portion of the duffle is zippered so that the top portion can be opened. The entire front flap can also be attached and reattached via zippering. Near the bottom, there is a horizontally placed zipper that runs around three sides and small portions of the fourth backside of the duffle. This can be used to detach the bottom portion of the duffle, swing it around so that it can be reversed, with the wheels turned inward, and the entire upper portion folded such that the duffle is fully collapsed.

Figure 2:
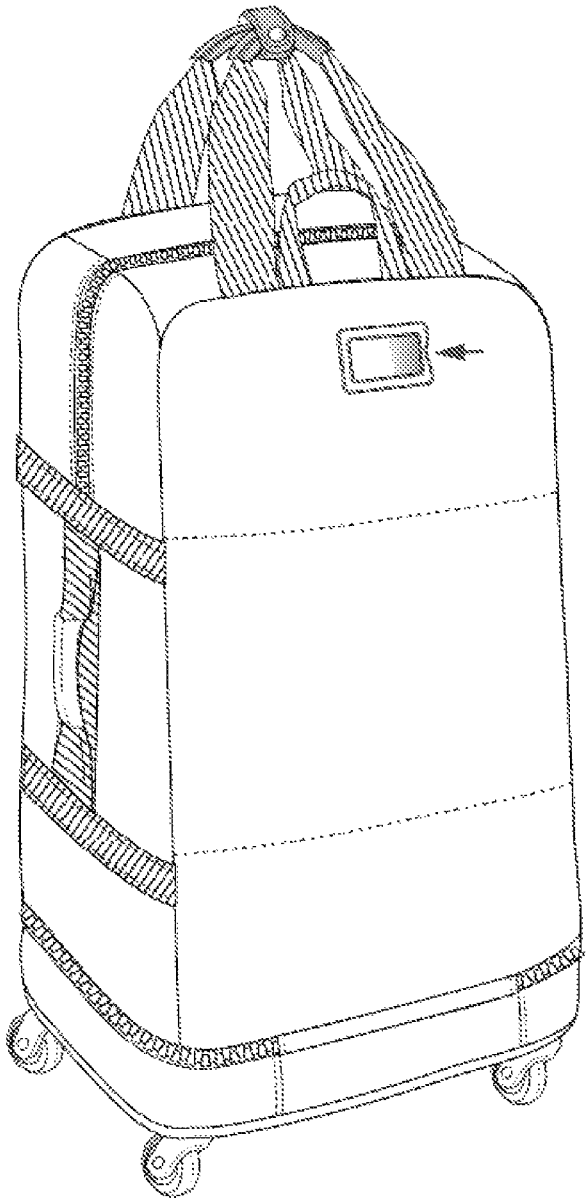
FIG. 2 depicts a rearview of the exemplary foldable duffle of FIG. 1.

FIG. 2 illustrates a rear view of the exemplary foldable duffle of FIG. 1. Visible in FIG. 2, at the top portion of the back side is a space for a business card or other identification of the luggage so that it can be readily identified in an airport or other public transport situation. As can also be seen at the bottom of FIG. 2 the horizontal zipper which surrounds three sides does not go across the entire fourth (rear) side of the duffle. Rather, only a small distance on each of the two outer edges of the rear panel is removably attached via the zipper. The band in the center of the rear panel is a kind of a cloth hinge about which the bottom portion of the foldable duffle can be swung for use in the collapsed state, as described more fully below.

Figure 3:
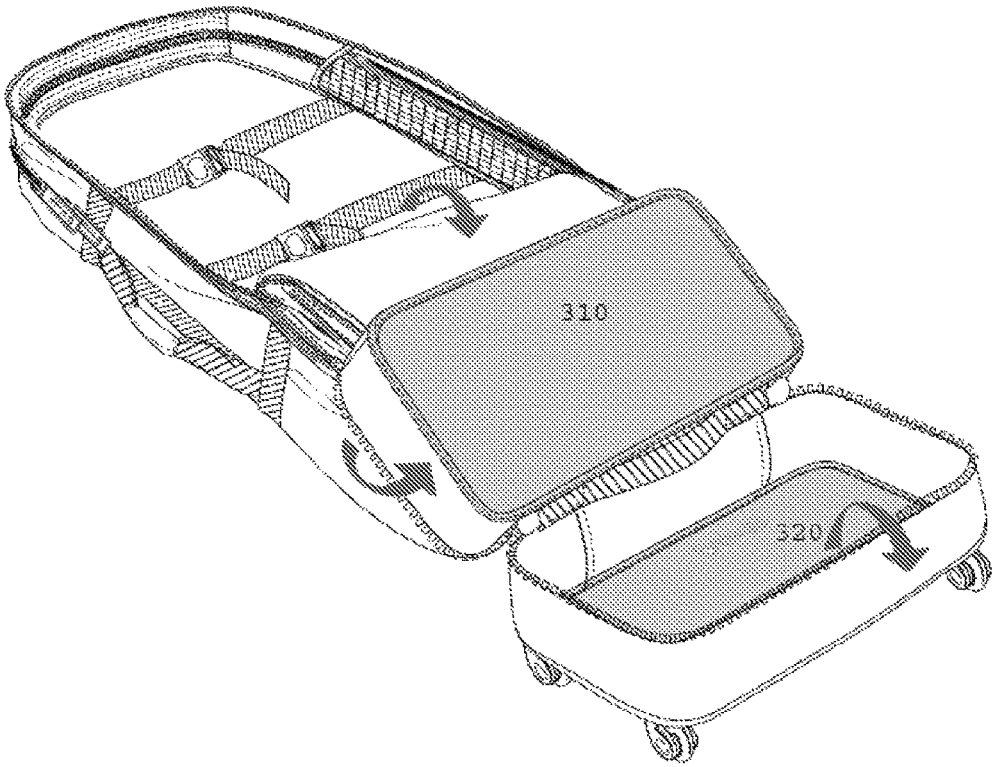
FIG. 3 illustrates the foldable duffle of FIGS. 1 and 2 as laid horizontally and with the top cover and the bottom portion unzipped.
Figure 4:
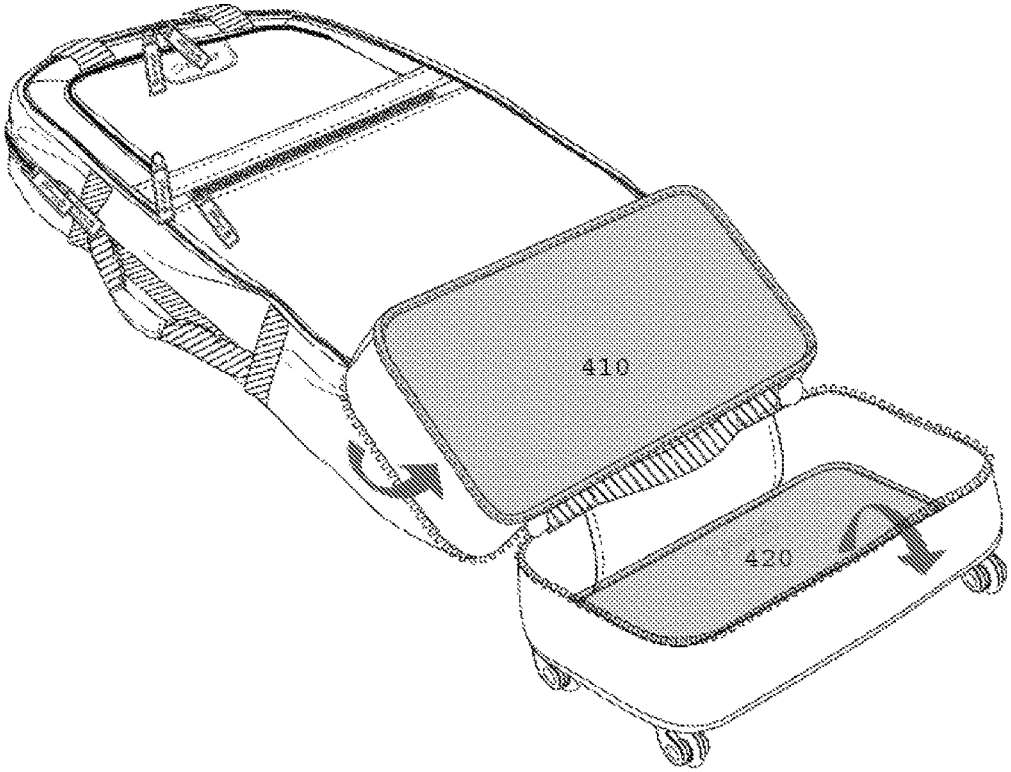
FIG. 4 shows a similar view as seen in FIG. 3 with the front cover zipped closed such that the front face of the foldable duffle can be seen and only the bottom portion having been unzipped.
Figure 6:
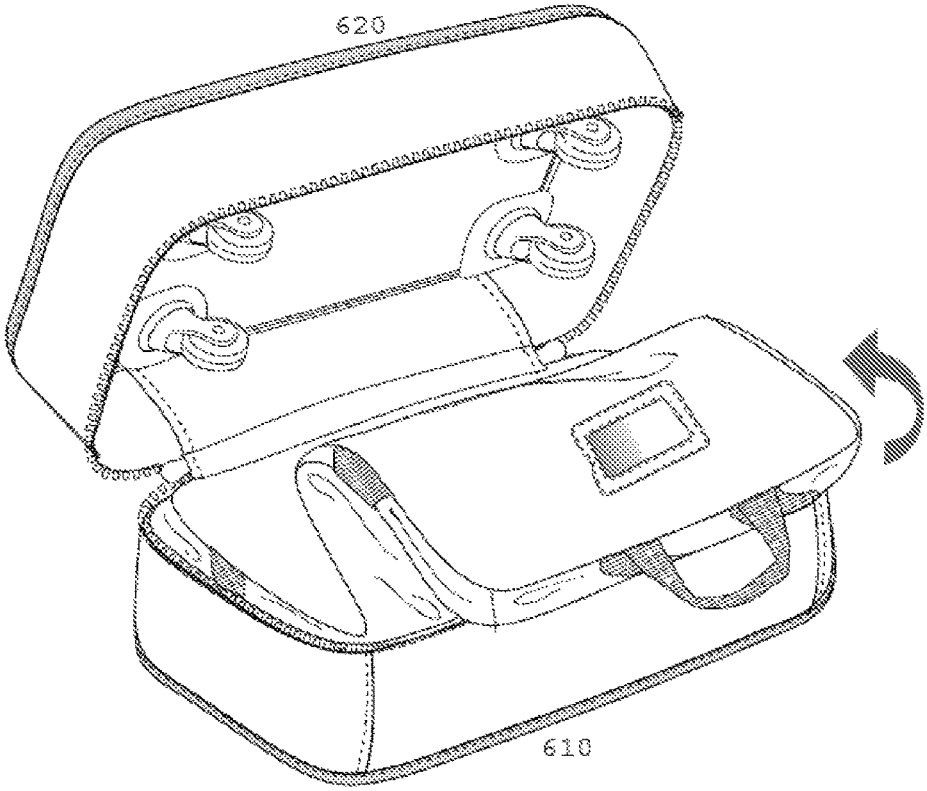
FIG. 6 shows the process of folding the upper portion, now collapsed, of the exemplary foldable duffle of FIG. 1 into what remains of the upper portion of the foldable duffle such that the lower portion (containing the wheels) can now be folded over on top of it.
Figure 7:
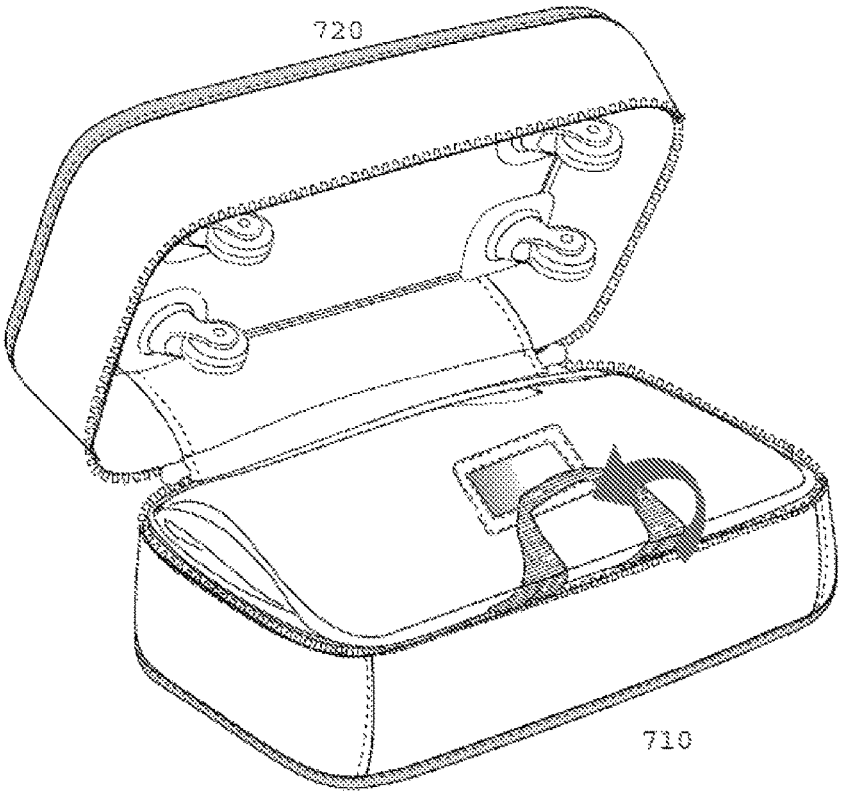
FIG. 7 illustrates the entire upper portion of the foldable duffle now stored in a lower portion of said upper portion of the foldable duffle.
Figure 8:
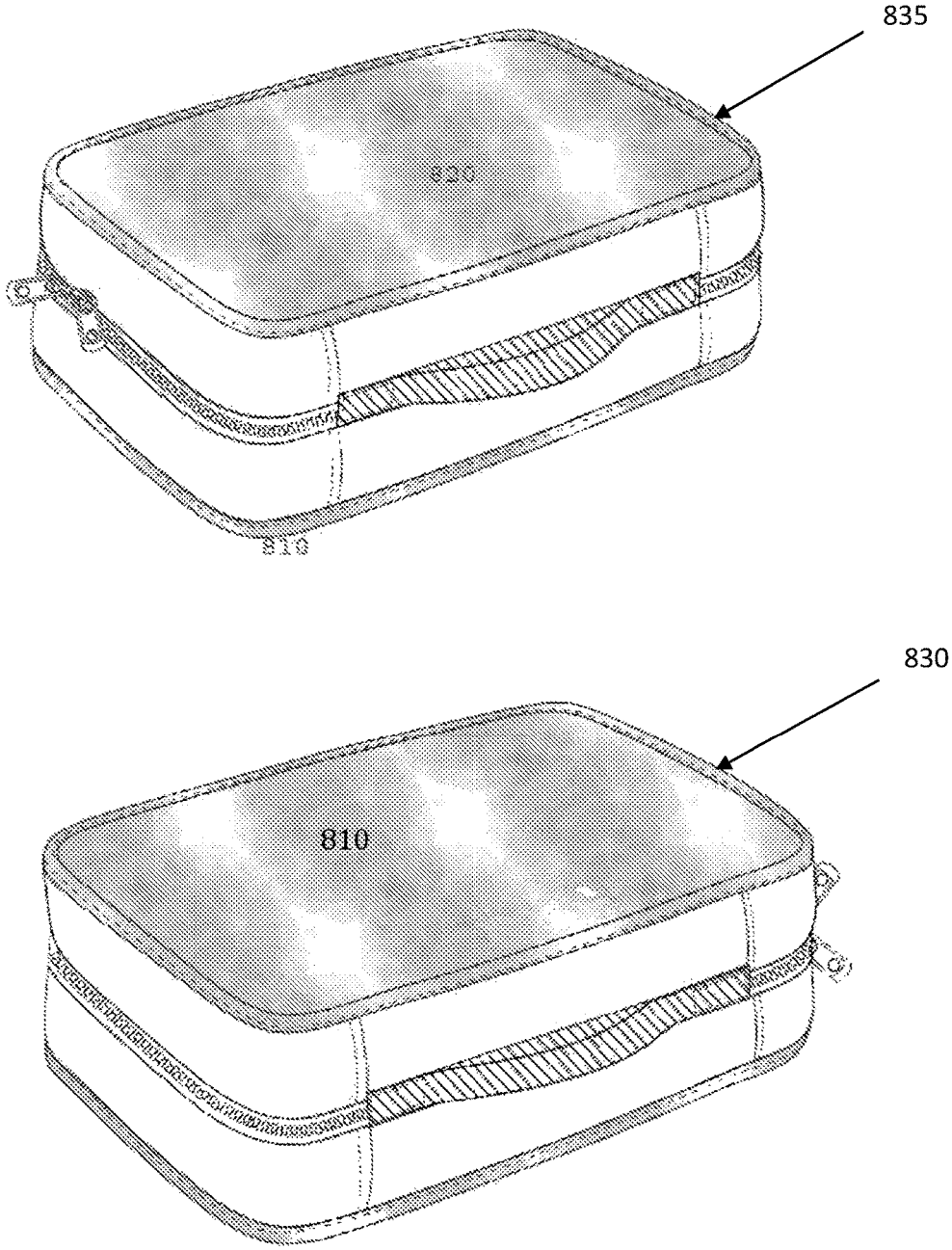
FIG. 8 illustrates the configuration of FIG. 7 after the zipper has been zipped between the bottom portion and the lower portion of the upper portion of the exemplary foldable duffle.

FIGS. 3-8, next described, illustrate the collapsing of the exemplary foldable duffle of FIGS. 1 and 2 into a fully collapsed state, as shown in FIG. 8. With reference to FIG. 3, the duffle is now shown in a configuration similar to that of FIG. 1 where the duffle has been spread out horizontally to rest on its rear panel, and the bottom portion has been separated from the remainder of the exemplary duffle by unzipping the zipper. As can also be seen in FIG. 3, the front flap has been entirely unzipped prior to folding, although this is not necessary, as shown in FIG. 4 below. Thus the exemplary duffle can be collapsed without unzipping the front flap.

Further visible in FIG. 3 is the second rigid surface of the foldable duffle. An interesting feature of the exemplary foldable duffle of FIGS. 1-9 is that there are two rigid surfaces which define front and rear panels once the duffle is in its fully collapsed state, as shown in FIG. 8. As can be seen in FIG. 3 these are shown as two shaded planes which have piping or a frame on the perimeter; one is visible at the bottom portion of the duffle and it is the plane into which the four wheels are connected. The top rigid surface is the one that has been angled back so that it rests in a semi-horizontal orientation, at about an angle of 30° with the remainder of the upper portion which lies underneath it.

When the exemplary foldable duffle is in the configuration of FIG. 1, these two shaded surfaces touch each other and the upper shaded surface fits neatly within the cup-like or box-like structure made by the bottom surface and the ring of fabric surrounding it, as shown in the bottom of FIG. 3. The upper rigid surface fits inside the bottom rigid surface like two stacked bowls, for example. Once the bottom portion of the duffle is unzipped, this bottom portion of the upper portion which had been "stacked" or fit within the bottom portion can be swiveled upwards as shown. Also visible in FIG. 3 is a curved arrow shown in the bottom portion of the foldable duffle. This indicates that the bottom panel of the bottom portion of the foldable duffle needs to be reversed on itself so that the ribbon of fabric surrounds and encompasses the four wheels; in other words the ring of fabric or other material is turned inside out such that the wheels point to the interior of the bag or duffle in its collapsed state.

As noted, FIG. 4 is identical to FIG. 3 except that the front flap of the exemplary foldable duffle has not been unzipped and therefore the upper portion of the foldable duffle will be folded over without unzipping the front flap. In all other respects, FIG. 4 is identical to FIG. 3.

Figure 5:
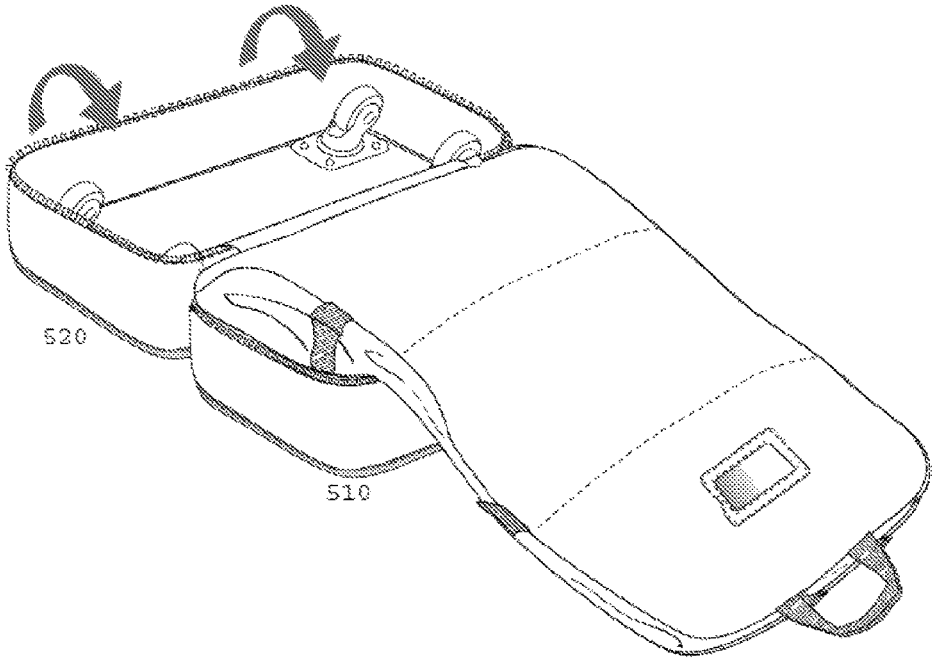
FIG. 5 shows the exemplary foldable duffle of FIG. 4 turned over and the bottom portion having been turned inside out such that the wheels are in the interior.

FIG. 5 is the view of FIG. 4 rotated 180° about an axis perpendicular to the page where the foldable duffle has also been flipped over or rotated about the plane of the paper by 180° as well. Moreover, the four wheels have been turned inside out such that the ring of fabric comprising the bottom portion of the foldable duffle now surrounds the four wheels which are now contained within its interior. This reversal of the bottom panel of the bottom portion thus sets the stage for the foldable duffle to be fully collapsed. This process is shown as continuing in FIG. 6 where the upper portion of the foldable duffle is now shown on the bottom Also seen in FIGS. 3-6 is labeling of the two rigid panels of this exemplary foldable duffle for ease of identification and visualization of the collapsing process. The upper panel, which is the bottom portion of the upper portion of the foldable duffle, is labeled as 310 or 410 or 510 (last two digits are always "10") in these figures, and the bottom panel which is the bottom most panel of the entire duffle and the supporting panel onto which the wheels are provided, is labeled as 320, 420 and 520, etc. (last two digits are always "20"). By following this labeling in FIGS. 3-8, one can mentally orient how the duffle actually folds on itself in 3D.

The process of folding continues as shown in FIG. 7 where the entire upper portion of the foldable duffle is now entirely within the bottom portion or bottom cup-like portion of the upper portion as shown in the foreground of FIG. 7. The arrow in FIG. 7 indicates that the upper portion of the foldable duffle—which has no rigid panels and therefore easily collapses—needs to be folded completely within that cavity.

FIG. 8 shows the top portion of FIG. 7 having been totally folded over and zipped onto the bottom portion of FIG. 7 such that now the bottom rigid panel 820 is on top and the upper rigid panel 810 is on the bottom. FIG. 8 also shows in the bottom image the same configuration as shown in the upper image except that an exemplary trademark is shown embossed, imprinted or painted onto the bottom panel 820, for example, as may be desired. This insignia is only visible in the collapsed state, as the rigid panels are only on exterior faces in such collapsed state. Finally, FIG. 8 shows frame 835 provided at the perimeter of bottom rigid panel 820, and frame 830 provided at the perimeter of upper rigid panel 810. Frames 835 and 830 may be made from one or more of wire, carbon fibers, and dowels.

Finally, FIG. 9 synoptically recapitulates the various folding steps of FIGS. 3-8 and therefore has five (5) related images, as follows. Beginning at the left of FIG. 9, the bottom portion has been unzipped and the bottom portion of the upper portion of the duffle has been swiveled or rotated out of the cavity of the bottom portion as in the case of FIGS. 3 and 4. It is noted that in this portion of FIG. 9, one can now easily see the bottom rigid panel 920 and the upper rigid panel 910; this leftmost image is equivalent to FIG. 4.

Figure 9:
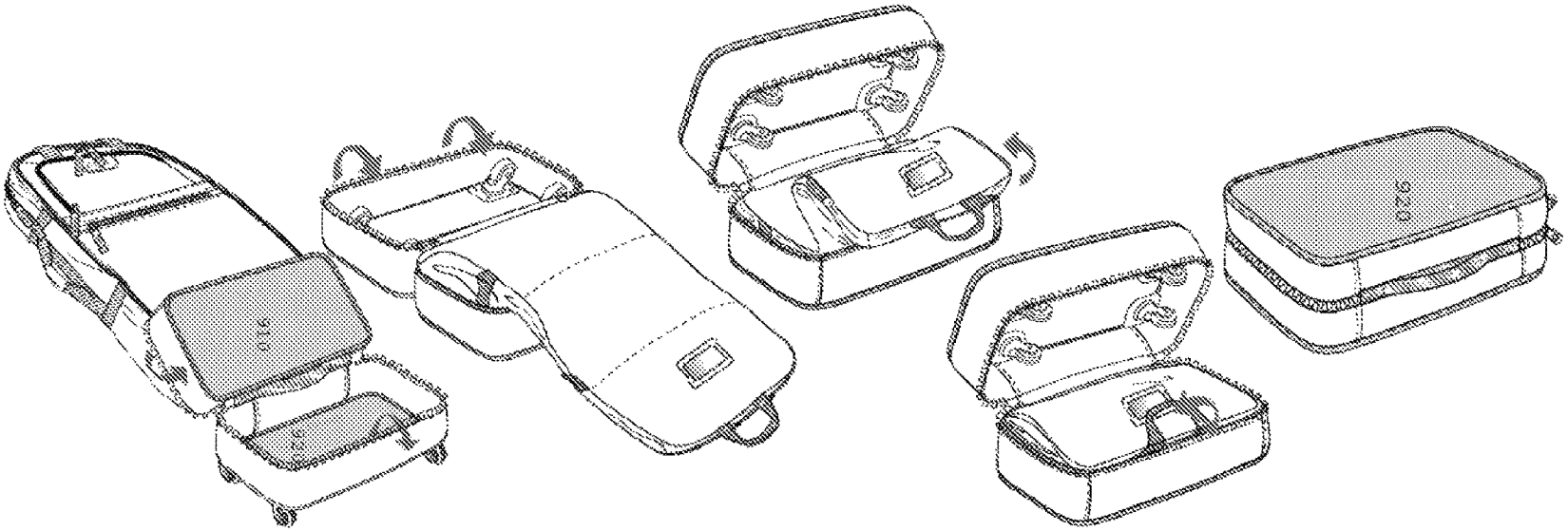
FIG. 9 recapitulates the various folding steps shown in FIGS. 3-8 synoptically.

Moving to the right of FIG. 9, the foldable duffle has now been rotated about an axis perpendicular to the page, and has also been rotated 180° about the plane of the paper. Thus the ring of fabric connected to the bottom rigid panel 920 has been turned inside out so that now the wheels protrude upward instead of downward and therefore point towards the interior of the bag. Moving farther to the right in FIG. 9, to the third, fourth and fifth images, there is simply another drawing of each of FIGS. 6, 7 and 8 showing the completion of the folding process as described above, ending in the far right image of FIG. 9 which is equivalent to the bottom image of FIG. 8. The visible rigid panel is the same bottom panel 920, the panel to which the wheels are connected.

Figure 10A:
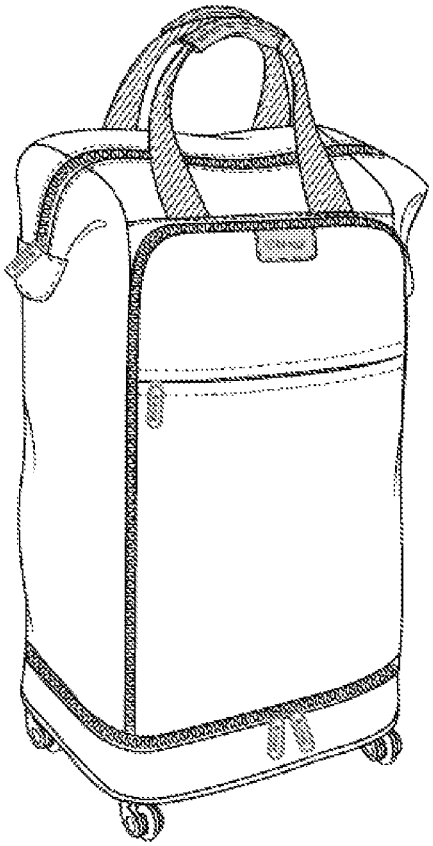
FIG. 10A shows a front view of an alternative exemplary embodiment of a foldable duffle according to exemplary embodiments of the present invention.
Figure 10B:
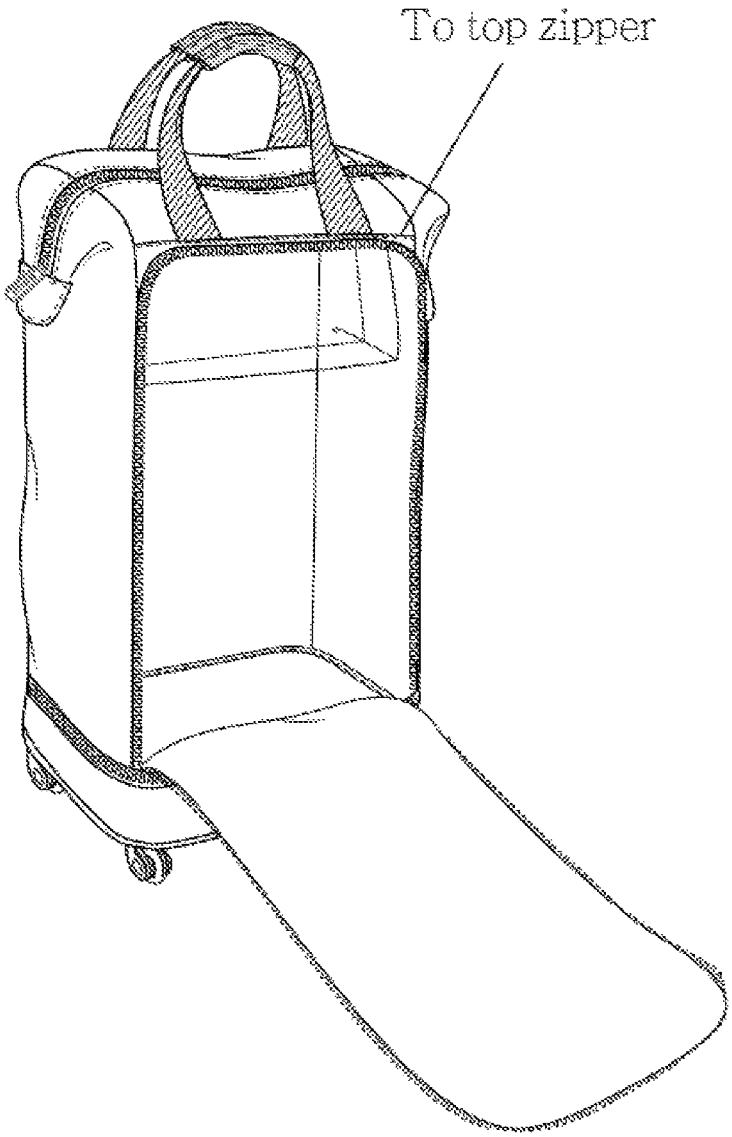
FIG. 10B shows the folding duffle of FIG. 10A with the front flap unzipped and opened.
Figure 10C:
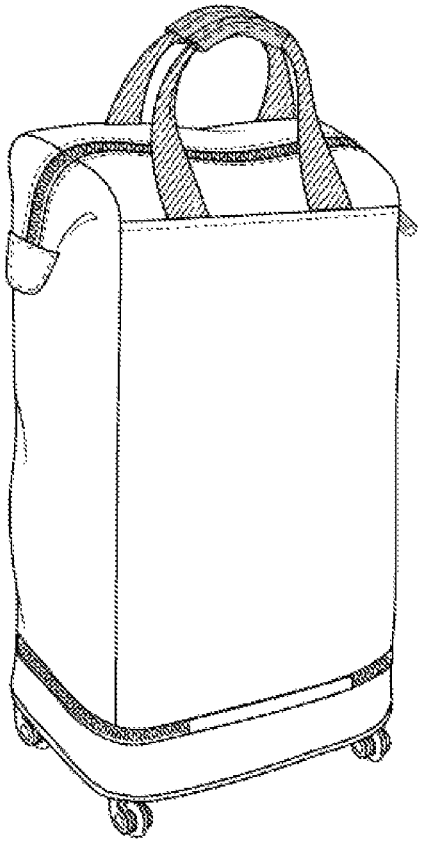
FIG. 10C shows a rear view of the folding duffle of FIG. 10A.
Figure 11:
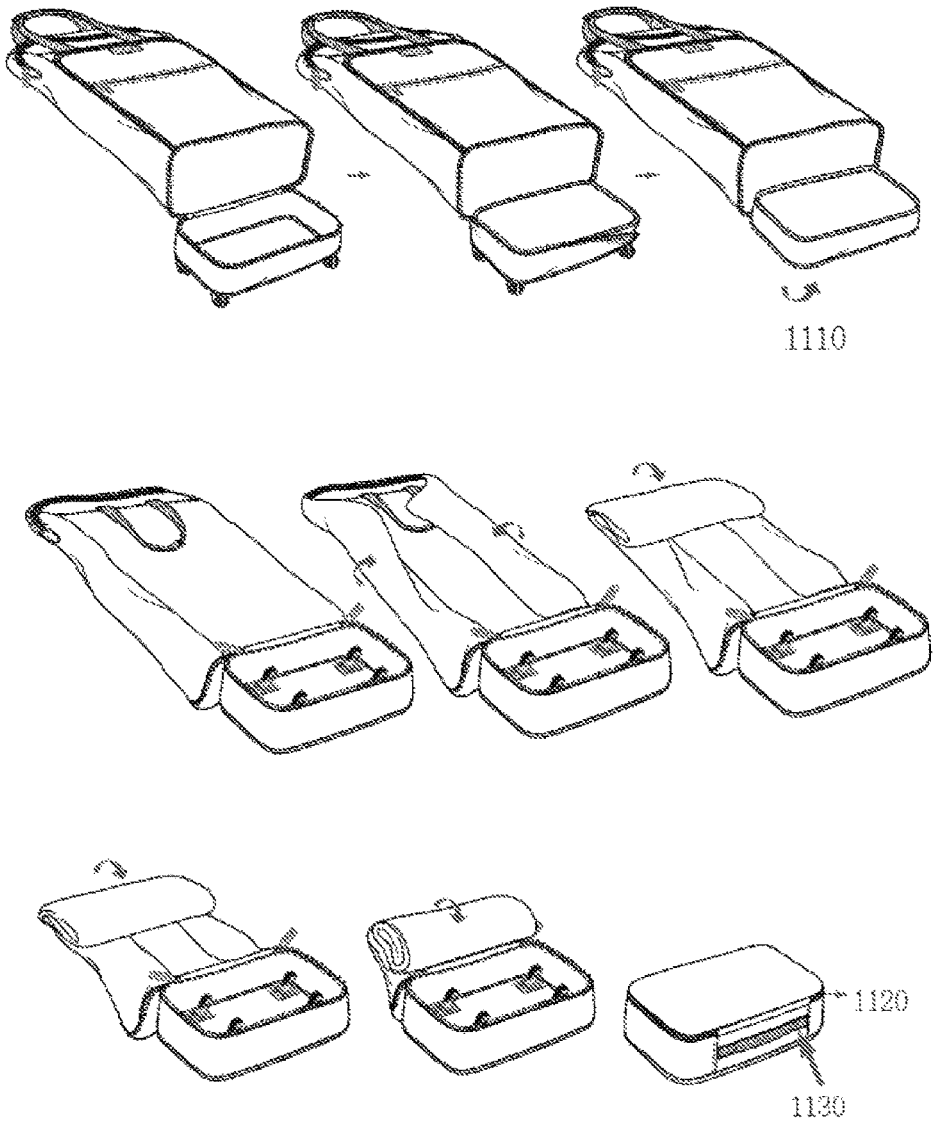
FIG. 11 shows a series of steps of collapsing, reversing, folding and closing the exemplary foldable duffle of FIGS. 10A, 10B and 10C.

FIGS. 10 and 11 show an alternate exemplary embodiment of the 4-wheel folding duffle of FIGS. 1-9, where there is no structural panel provided in the top portion, i.e., the portion which does not contain the 4 wheels, of the duffle, which is thus all soft material. The only structure to the article thus being the horizontal surface on the bottom to which the 4 wheels are attached. This is a variation of the duffle of FIGS. 1-9, which has two structural panels, one to which the wheels attach, and the other being connected to the upper portion, as described above. Therefore, with reference to FIG. 10A, a front view is shown, where is seen an exemplary 4-wheel bag with a zipper running horizontally across the bottom, to allow for swiveling upwards of the bottom portion, and in FIG. 10B the flap in the front of the bag is totally unzipped to illustrate how the bag opens. In FIG. 10C a rear view of the bag is shown.

With reference to FIG. 11 there are shown exemplary folding steps of the exemplary 4-wheel duffle of FIG. 10. With reference to the top left of FIG. 11, the zipper is totally unzipped, and at 1110 the wheels have been turned inside out. In the middle row of FIG. 11 the upper portion of the bag has begun to be folded and rolled on itself, as shown by the arrows, and the bottom portion which contains the 4 wheels has been inverted so that the cloth band running around the perimeter of the bottom portion of the duffle is now pulled down over the wheels, and now facing upwards. Shown in the middle and bottom rows of the figure, the entire structure is rolled up on itself and can be closed by zippering the zipper. It is noted that unlike the case of FIGS. 1-9, the exemplary compressed four wheel duffle of FIG. 10 has a lesser depth, because the zipper now does not run along the center of the bag in its compressed state but runs along its top, as shown at 1120, and there is a handle 1130 centered on the thickness of the bag. This is also illustrated in the photographs provided below of the "blue" exemplary duffle, shown in FIGS. 36-54.

Figure 12A:
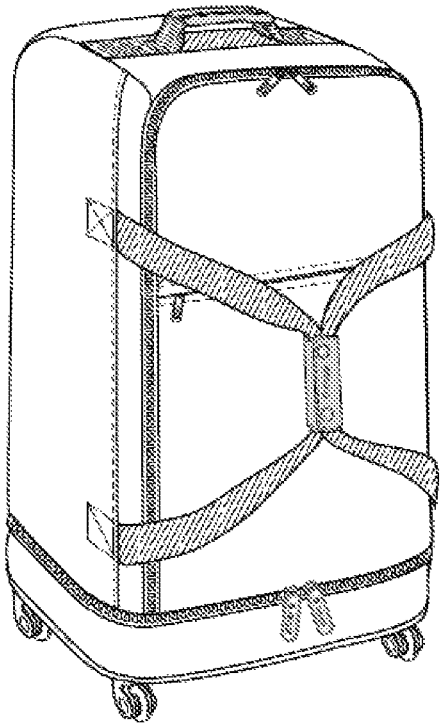
FIG. 12A depicts a front view of an alternate exemplary variation of the foldable duffle of FIGS. 10A, 10B and 10C wherein instead of a pair of handles on the top of the article there is a pair of handles arranged on the front face so that the article can be carried horizontally.
Figure 12B:
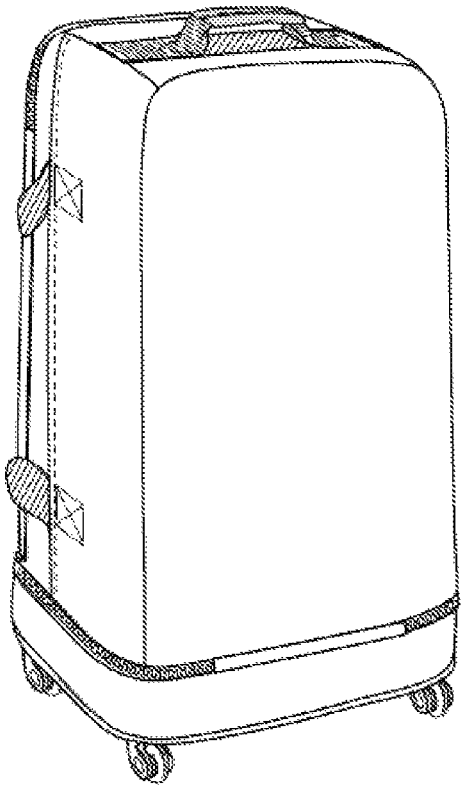
FIG. 12B depicts a rear view of the folding duffle of FIG. 12A.
Figure 13:
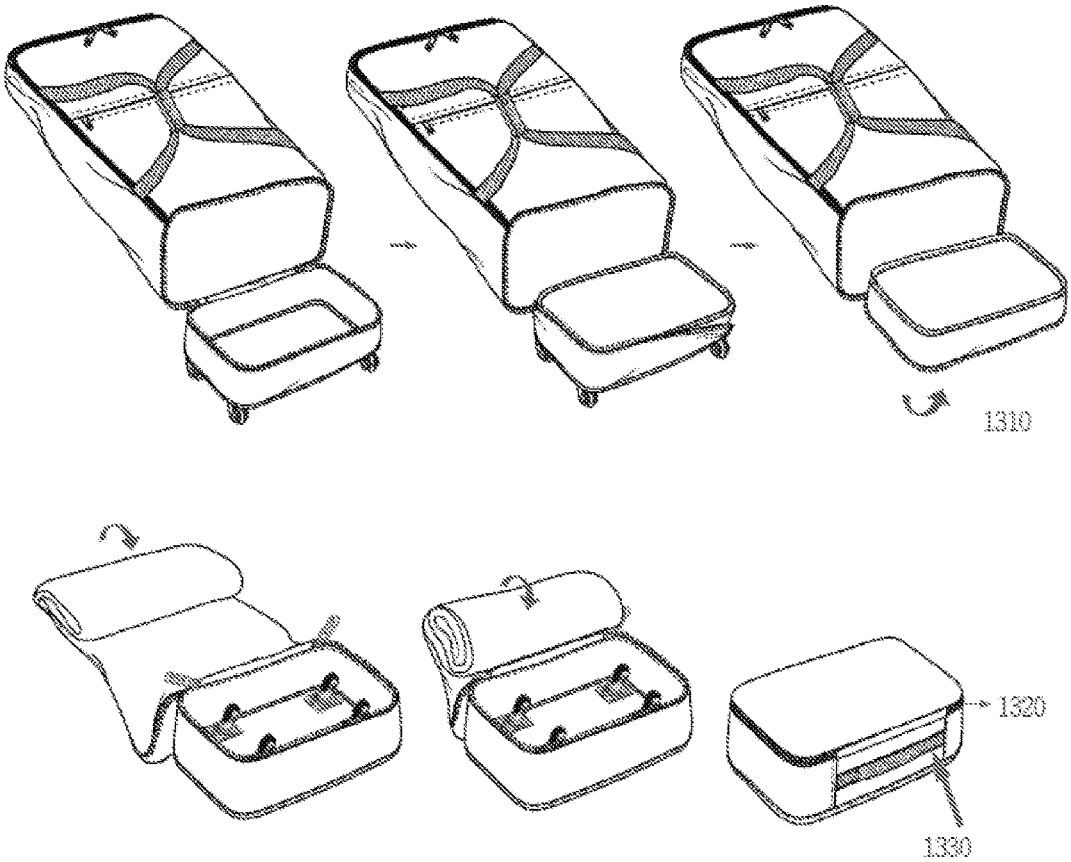
FIG. 13 depicts various steps in collapsing, reversing, folding and closing the exemplary foldable duffle of FIGS. 12A and 12B synoptically.

FIG. 12 are similar to FIG. 10, but show an exemplary duffle with handles on the side as opposed to on the top. In all other respects it is similar to the duffle of FIGS. 10-11. FIG. 12A presents a front view, and FIG. 12B a rear or back view. Finally, with reference to FIG. 13 the same folding steps as were illustrated in FIG. 11 are provided for the exemplary duffle of FIG. 12. Items 1310, 1320 and 1330 refer to analogous features and elements to elements 1110, 1120 and 1130 of FIG. 11, as described above. As noted, the main difference as regards this exemplary duffle lies in the handles provided along the front face of the duffle so that the duffle can be primarily held or carried in a horizontal position. In all other respects the folding of the exemplary 4-wheel duffle of FIG. 13 is the same as for the case of the exemplary duffle of FIG. 11. It is noted that an upper portion of such a duffle can be folded, rolled or collapsed using some combination of the two so as to fit into the inverted bottom portion. In exemplary embodiments this depends upon the size, thickness of material, and various other design factors. FIG. 11 illustrates folding and rolling, and FIG. 13 illustrates simple rolling. Various combinations are possible.

Figure 14A:
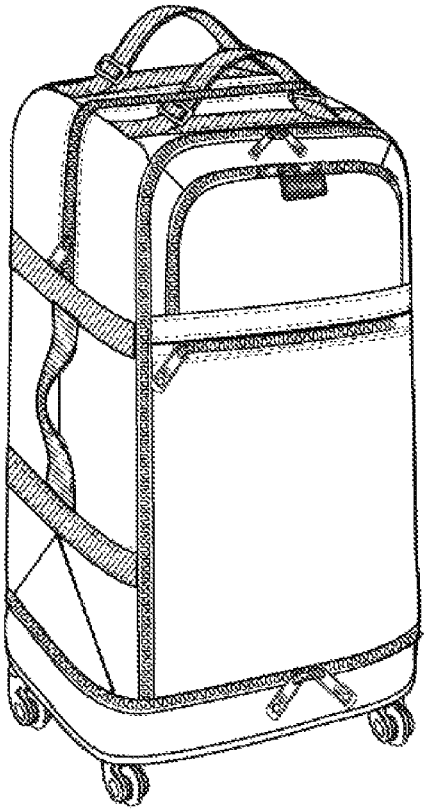
FIG. 14A depicts front and rear views of an alternate exemplary embodiment of the exemplary foldable duffle of FIGS. 1-9 having two handles on the top as well as certain aesthetic and design differences.
Figure 14A:
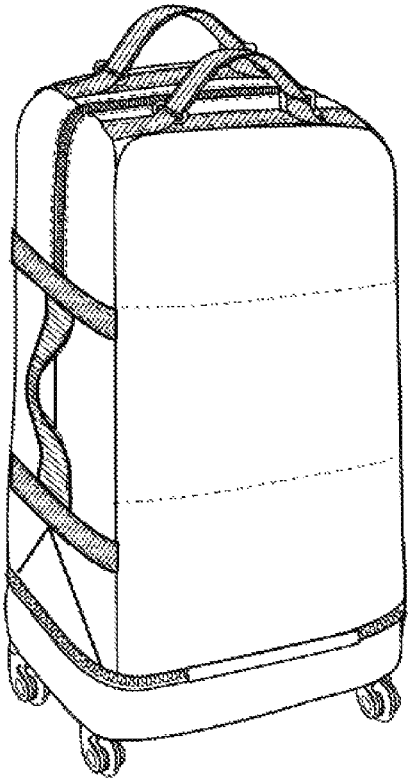
Figure 14B:
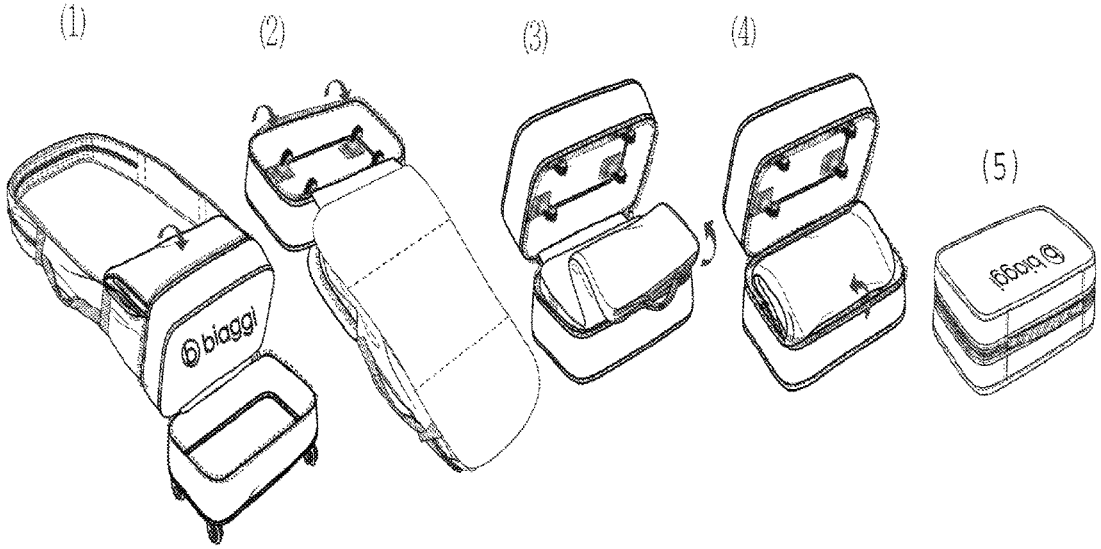
FIG. 14B shows a series of steps of collapsing, reversing, folding and closing the exemplary foldable duffle of FIG. 14A.

FIG. 14 depict a similar exemplary foldable duffle to that shown in FIGS. 1-9. It illustrates a different approach to the handles on the top of the duffle, where they extend a lesser amount upwards, and do not connect. Various design variations as to handles, material composition, method of providing support to the semi-rigid panels are possible in exemplary embodiments of the present invention, and this is one illustration of that fact. In FIG. 14A, 1410 presents a front view, and 1420 a rear or back view. Various exemplary folding steps are shown at 1430 in FIG. 14B.

Thus, as shown in the folding steps 1430 of FIG. 14, first the zipper is unzipped completely, leaving the two portions of the bag connected at a small hinge like swath of material running across most of the rear side of the duffle. This swath can be reinforced, for example, and can be made of various materials besides cloth, fabric or animal hide, for example, such as metal or the like. For example, the swath or hinge can be made of the same material as is used in the upper portion and the lower portion of the duffle, the same material as used in the upper portion and the lower portion, but strengthened and reinforced, or from a different material than that used in the upper portion and the lower portion of the duffle. Then, as shown in folding step (1) the upper portion of the bag has begun to be folded on itself. As shown in (2) the bottom band of material has now been folded downward so as to cover or encompass the wheels—which are now upside down in an inverted position. As shown in folding step (3), the upper portion of the bag can be tri-folded so as to conveniently fit within the remainder of the top portion, and in folding step (4) it is fully fit within the remainder of the top portion. It is noted that the bottom part of the top portion (just above the zipper band) has a substantially horizontal surface, which now becomes—in the inverted and collapsed bag, one of the two semi-rigid surfaces of the final form, as described above in connection with FIGS. 1-9. It is into this horizontal surface as framed by a ring of material connected to it, which is the bottom of the upper portion of the duffle, that the remainder of the upper portion of the duffle is fit into, as shown at 1430(4). This surface, for example, can be made somewhat more rigid, such as by using padding or other structuring elements, for example, as well as wire, carbon fiber or other materials provided around its perimeter, as shown. Thus, for example, one or both of the horizontal surfaces can be reinforced with one of padding, thicker material, a mesh structure, a honeycomb structure, and/or a frame along its perimeter. The frame, for example, can be made from one or more of wire, carbon fibers, and dowels.

Thus, at 1430 folding step 5, the bottom portion is now folded back over the top portion such that the former bottom portion is now on top, with wheels inverted, and the zipper is once again zipped together. This time, however, the entire upper portion is folded inside and it assumes the carrying case configuration as shown in folding step 5.

Exemplary Prototypes

FIGS. 15 through 54 are next described. These figures are color photographs of two exemplary foldable duffles according to exemplary embodiments of the present invention. There is a prototype similar to that shown in FIGS. 1-9 and FIG. 14 (the red one with the "Biaggi" logo, with two rigid side panels), and there is also depicted a type similar to that as shown in FIGS. 10-13 (the blue one, with only one rigid side panel). Thus, the first type has essentially two similar rigid portions which are zipped together such that there is a rigid wire or structure on both of faces of the finished closed zipped up bag. The other prototype version, similar to the design shown in FIGS. 10-13, has only one face which is rigid and the other face is non-rigid. The advantage of the only one rigid face version is that it has a smaller thickness relative to the first type and may, in various exemplary uses, be preferred, whereas in other exemplary uses, the first type may be preferred.

Figure 15:
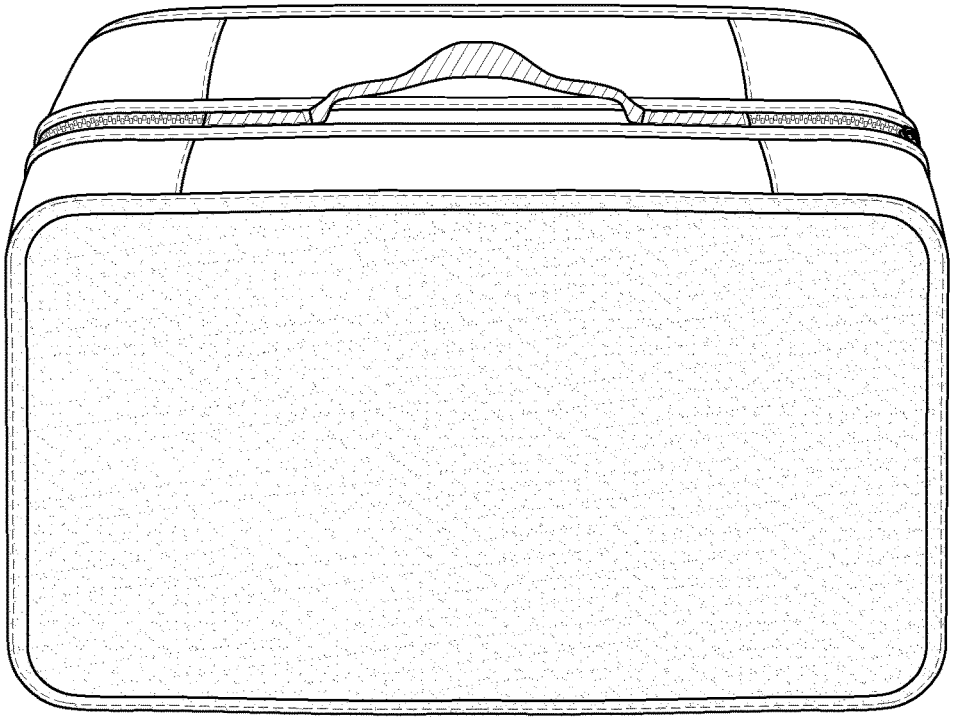
FIGS. 15 through 54 present various series of photographs of two exemplary prototypes of 4-wheel folding duffles according to exemplary embodiments of the present invention.
Figure 16:
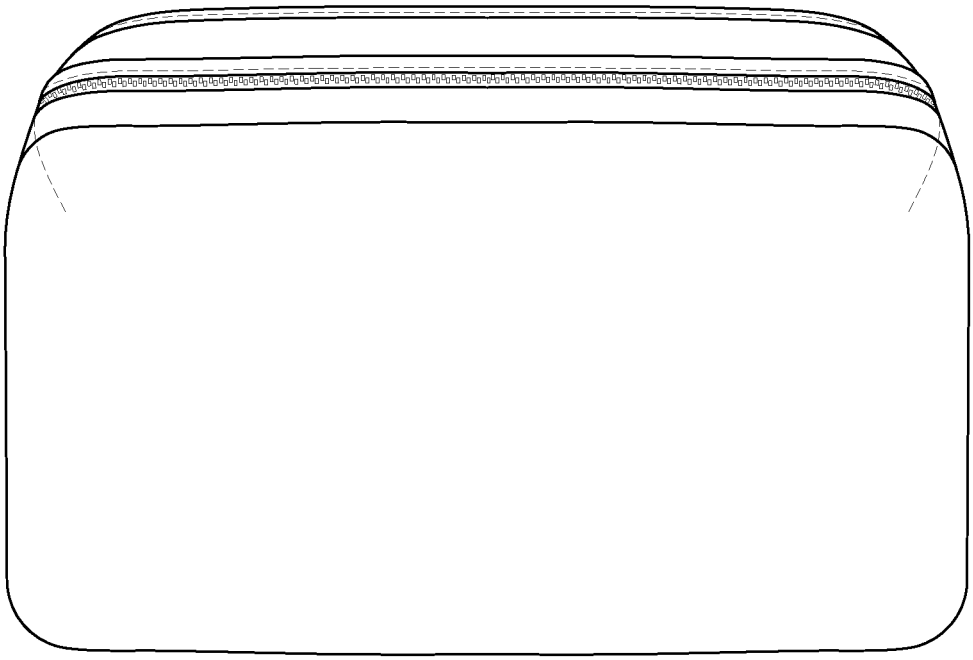
Figure 17:
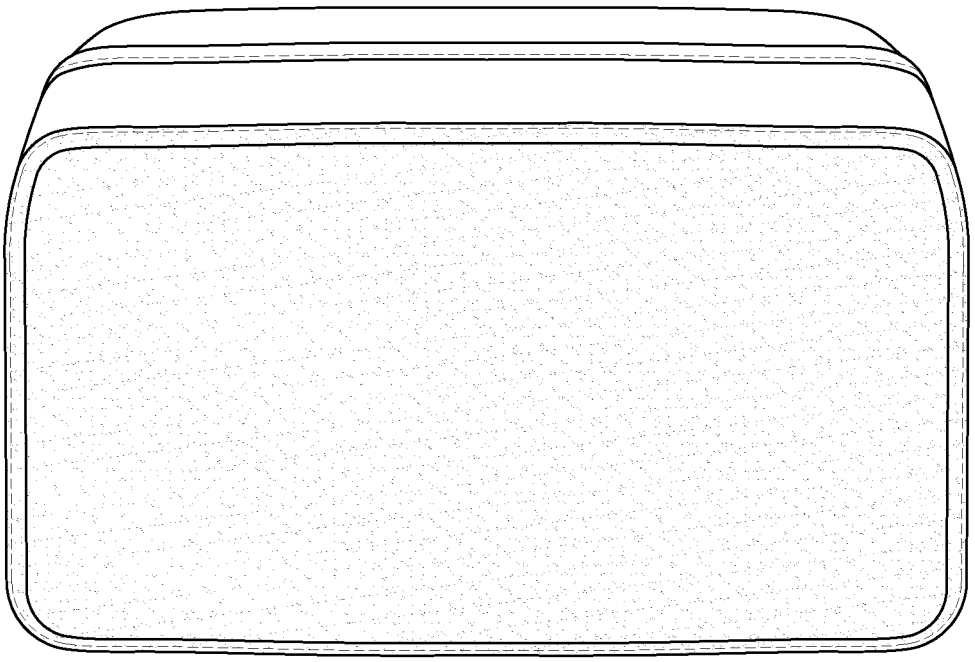
Figure 18:
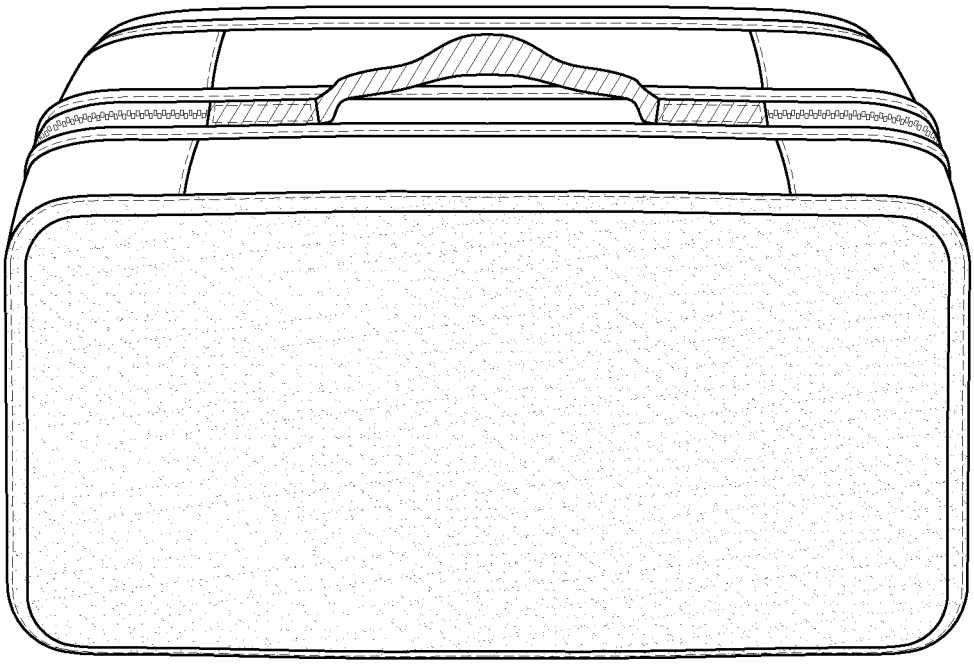

With reference to FIGS. 15 and 16 there is seen the two rigid face version and single rigid face version respectively shown in red and blue, and FIGS. 17 and 18 show the opposite views of both of these articles.

Exemplary Two Rigid Panel Embodiment

Figure 19:
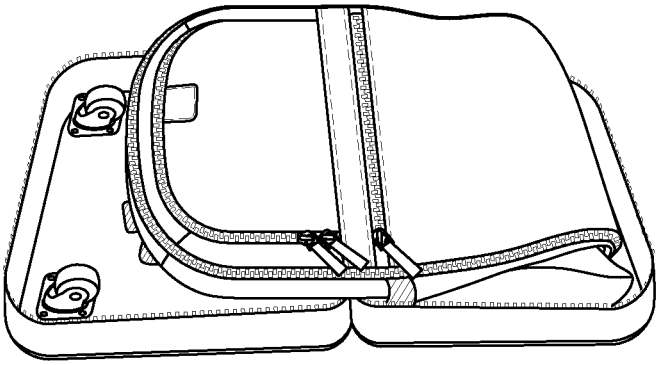
Figure 20:
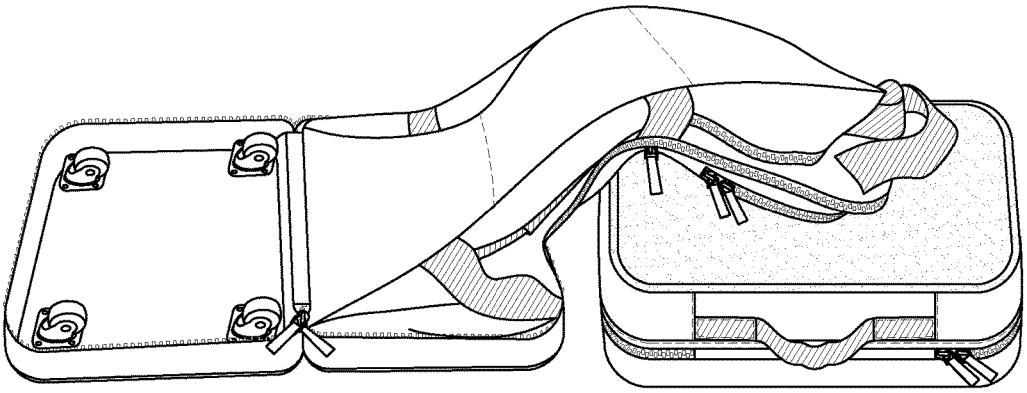
Figure 21:
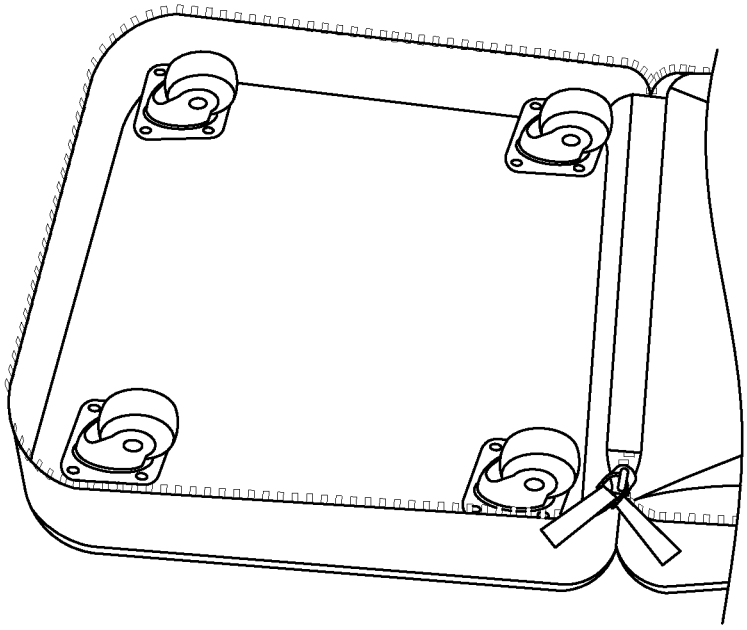

FIGS. 19 through 35 focus on the two rigid face version, the bag shown in red, next described. With reference to FIG. 19, one can see the bag unzipped from its collapsed state and the upper portion of the bag now visible. FIG. 20 shows the upper portion having been pulled outside of the top rigid portion and resting on the blue bag. FIG. 21 is a close up of the bottom rigid panel of the bag in which the wheels are provided, as shown, in the collapsed state so that the wheels are pointing towards the inner portion of the bag.

Figure 22:
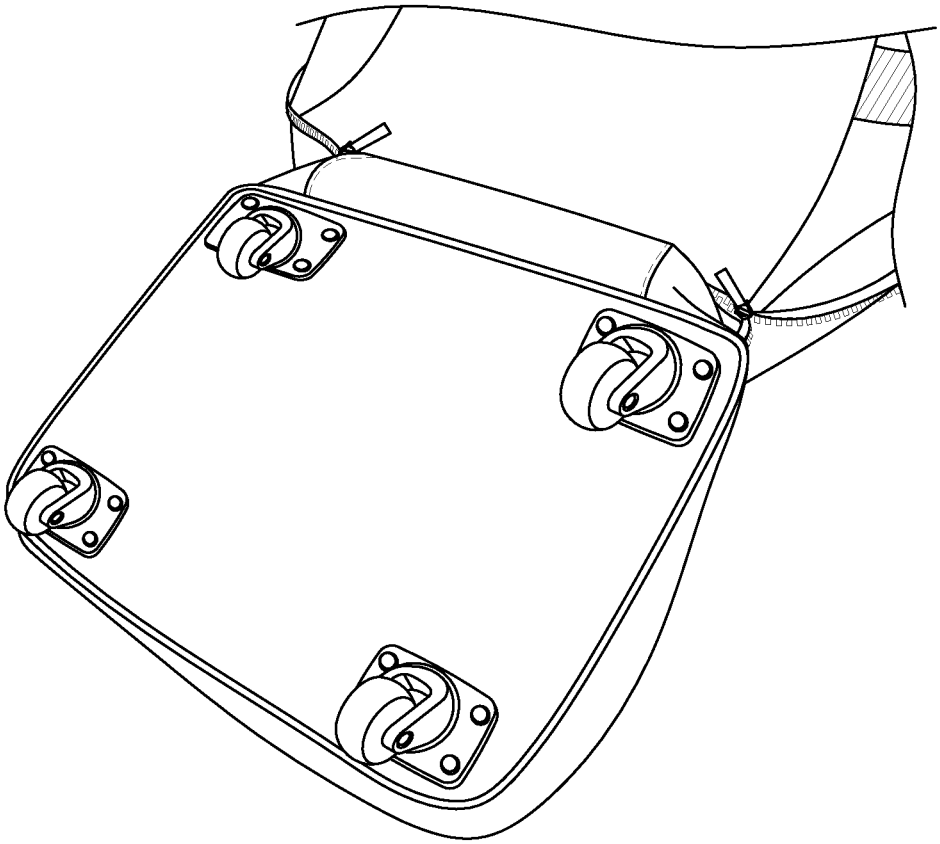
Figure 23:
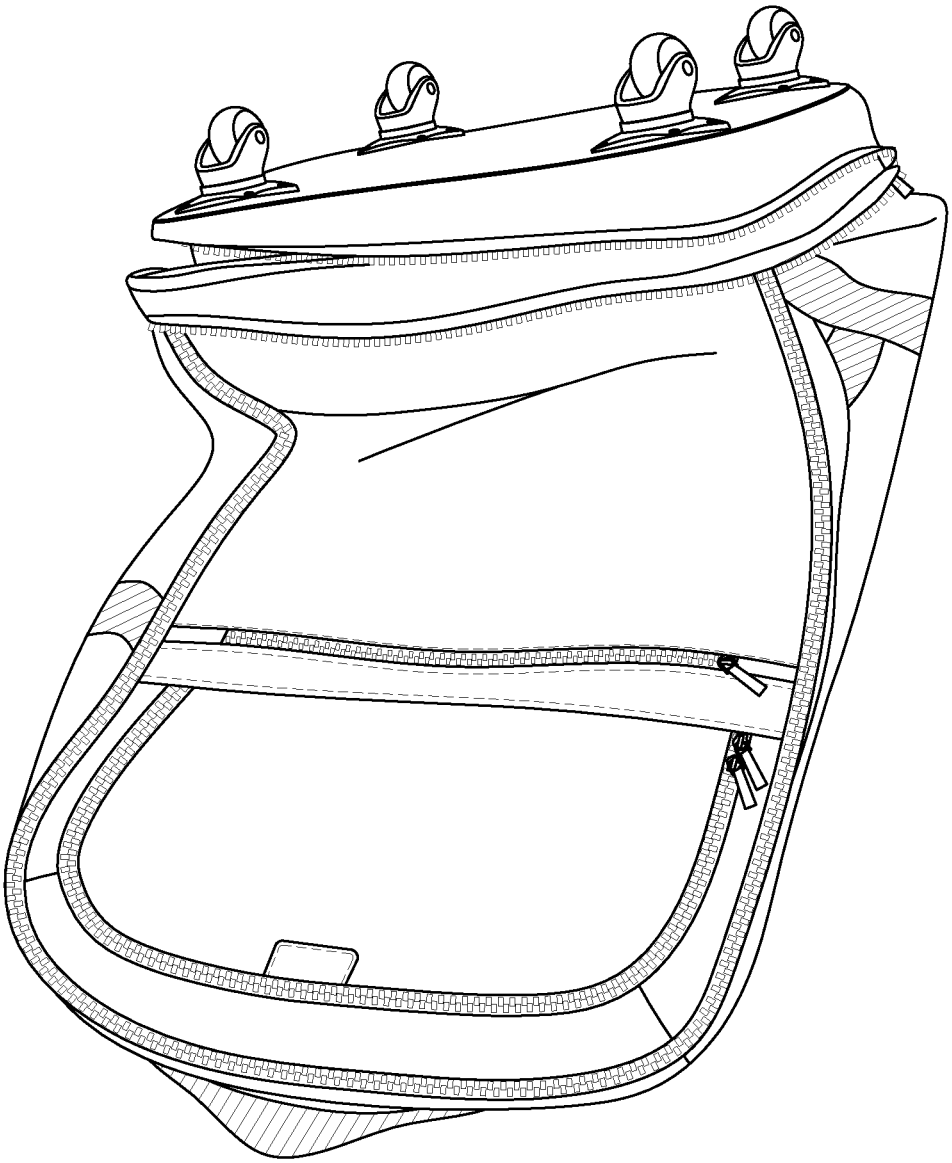
Figure 24:
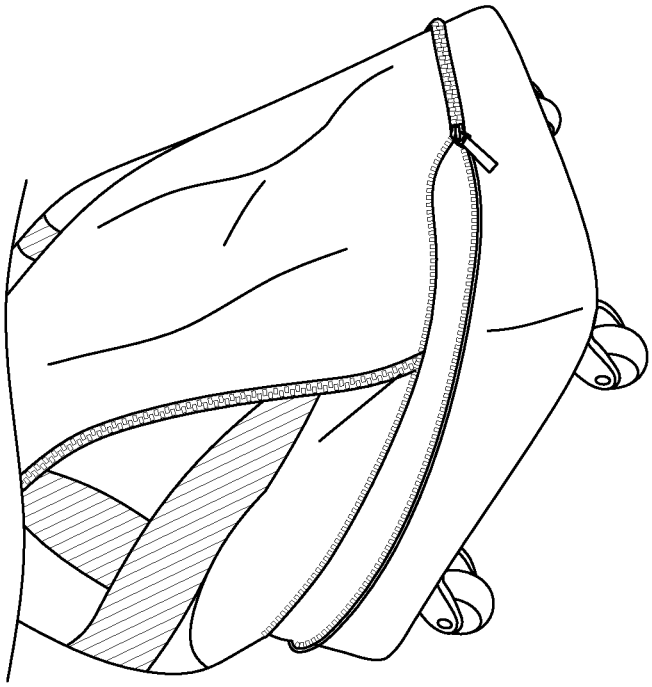
Figure 25:
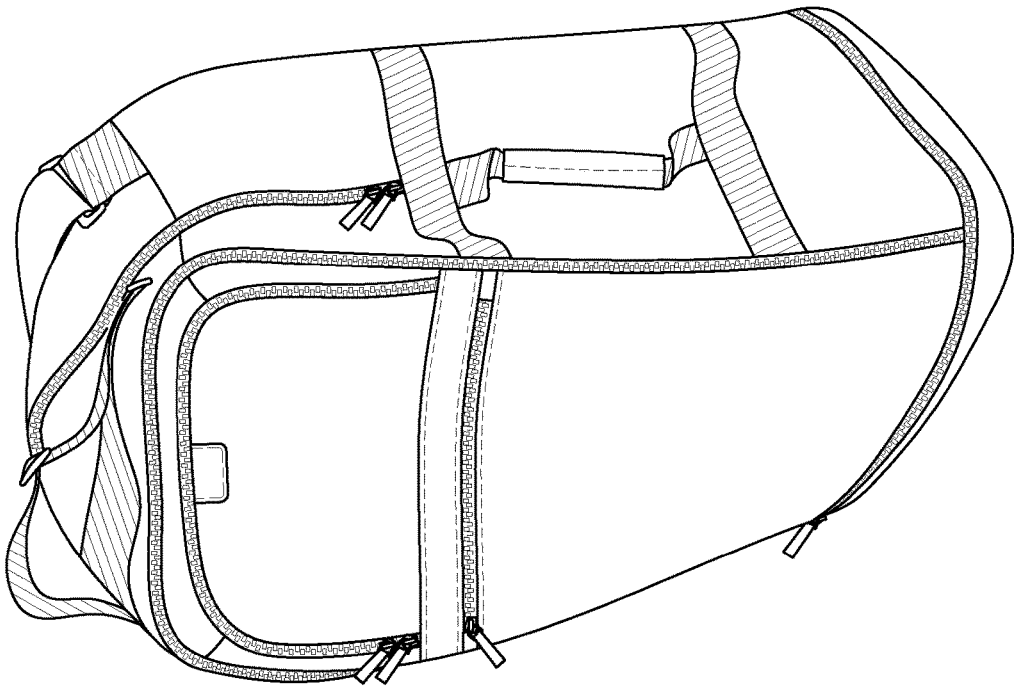

FIG. 22 shows the wheels now being reversed to their normal fully extended configuration where they protrude outside of the bag from the bottom panel of the luggage. FIG. 23 shows the configuration of FIG. 22 where the bottom panel has now been folded underneath the upper portion of the bag so that it can be zipped as shown in FIG. 24, and thus the bottom portion of the bag which gives it some structure and contains the panel holding the wheels is now fully attached to the upper portion of the bag as shown in FIG. 25. FIG. 25 is the bag shown in essentially its totally extended state, here laid on a surface horizontally. In some cases this is how it would be carried, but in others it would be carried from the top handles (so that it can be rolled on the wheels) and it would be thus provided in a vertical state.

Figure 26:
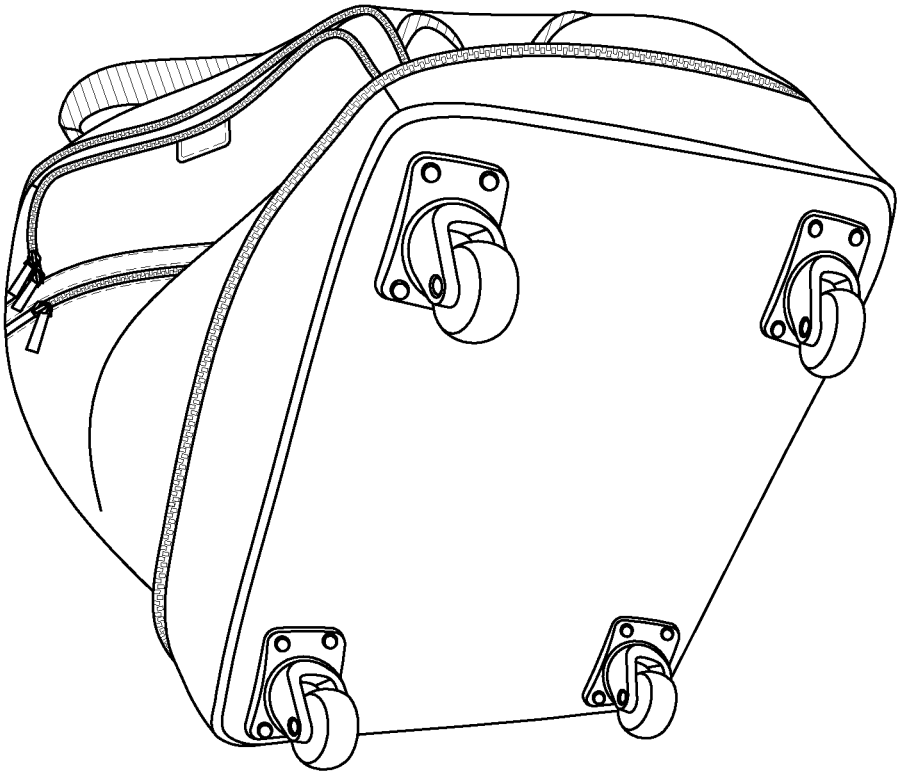
Figure 27:
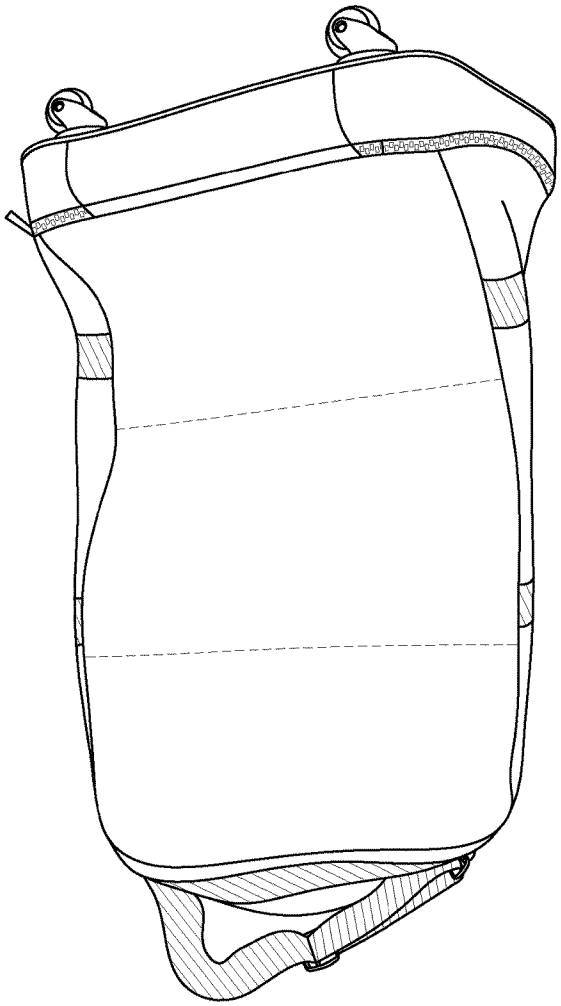
Figure 28:
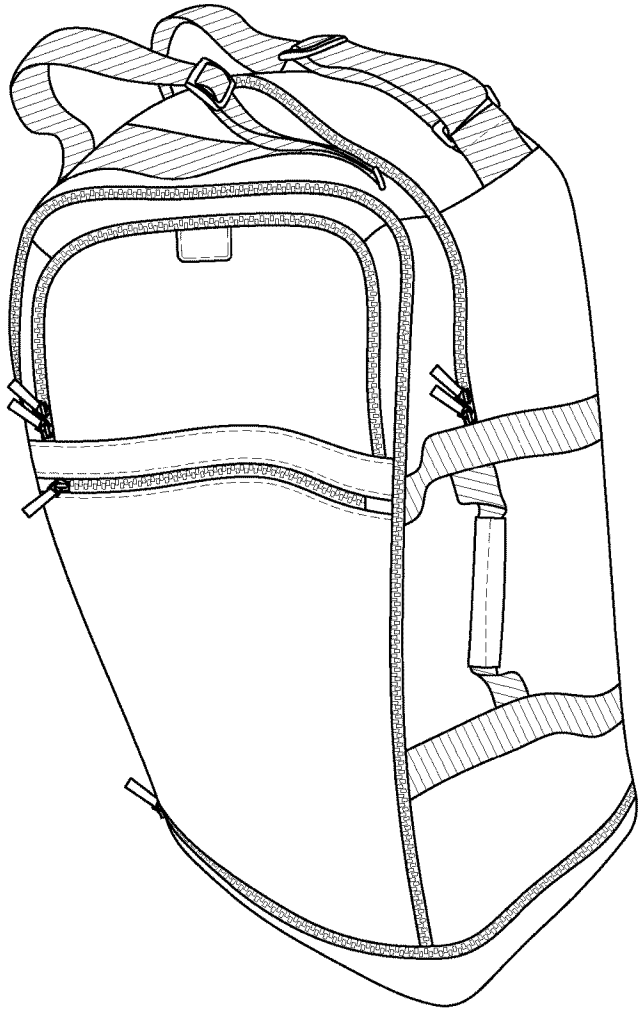
Figure 29:
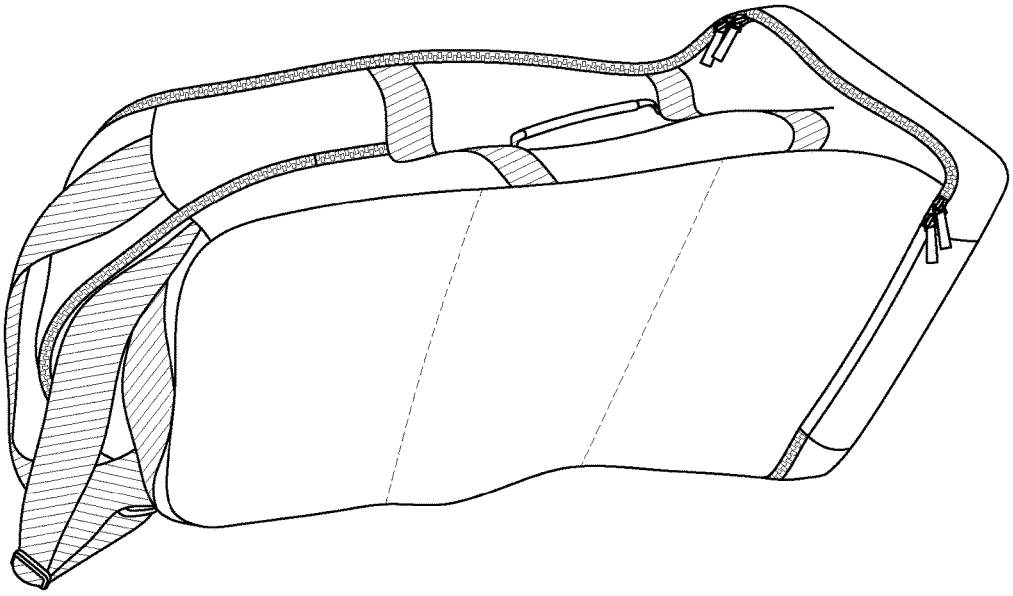

FIG. 26 is a bottom view of the configuration of FIG. 25, showing the wheels in the bottom panel of the foldable duffle and showing the bottom portion of the foldable duffle now zipped to the upper portion of the bag. FIG. 27 is a rear view of the configuration shown in FIGS. 25 and 26, and FIG. 28 is a view of the front and top portion of the same configuration. FIG. 29 is an alternate rear view also showing one side of the foldable duffle. It is noted that the face of the foldable bag in its collapsed state can be provided with a trademark identifying the bag. In the depicted configuration, the trademark can be placed on the inside portion of the bottom panel to which the wheels are fixed. Therefore the trademark is not visible unless and until the bag is collapsed and toted as a case, much in the nature of a small brief case or computer laptop bag. This is the configuration which gets the most attention, and thus makes for a good situation in which to display a logo, trademark or tag line (such as, for example "Zip-Sac" "Luggage That Folds", etc.).

Figure 30:
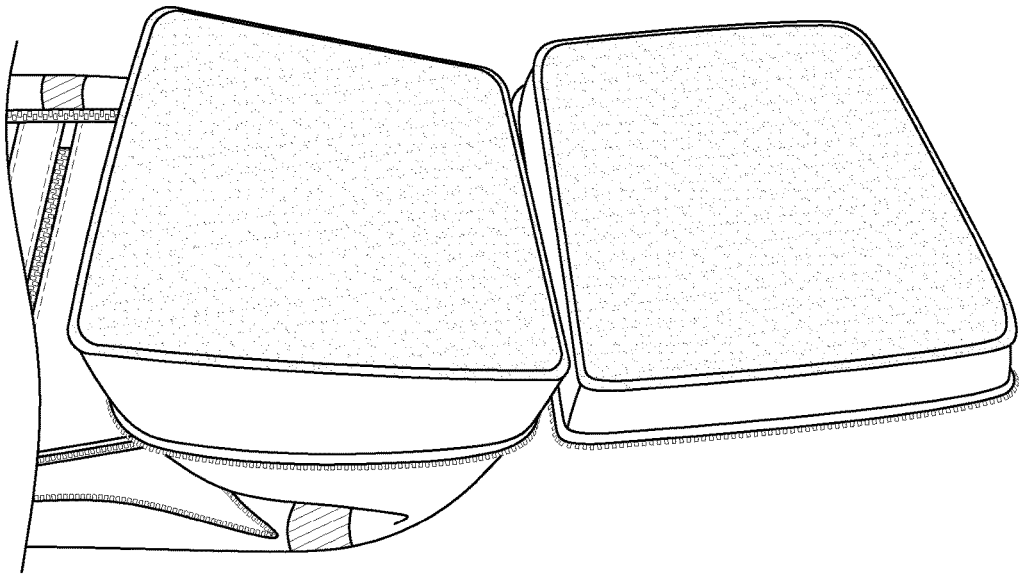
Figure 31:
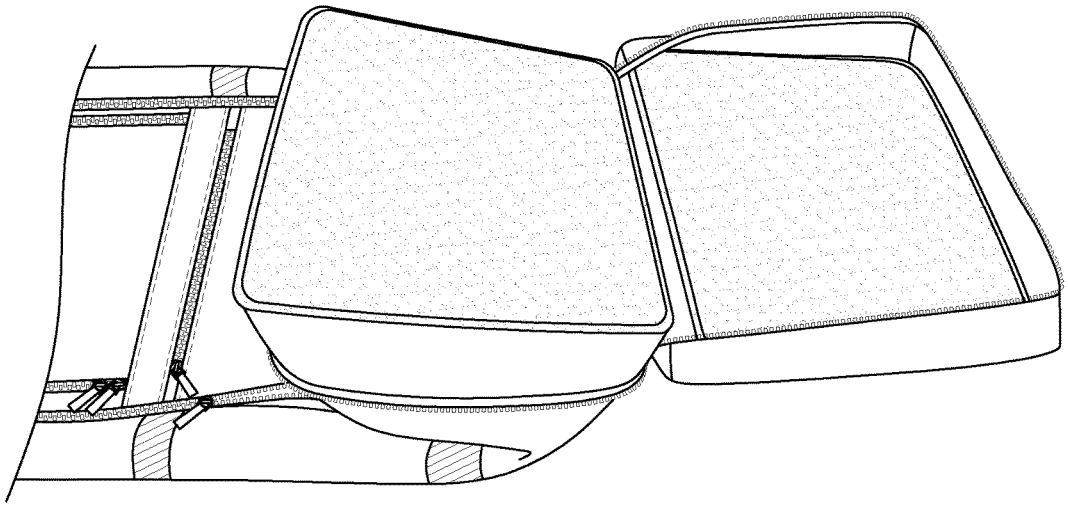

FIG. 30 illustrates the feature where the bag is once again in the process of being collapsed so the first step is to take the bag, unzip the bottom portion from the top portion and, as can be seen, when this is done there are two faces which come into contact with each other, one fitting inside the other, when the wheels are exposed. This is shown in the change from FIG. 30 to FIG. 31 where the former outside face of the bag as collapsed, which has the trademark printed on it, now becomes the bottom panel of the foldable duffle in the expanded state and the wheels protrude from it, as shown in FIG. 31. The trademark now being on the underside, on the same panel form which the wheels protrude. What is also seen in FIG. 31 is that the other face of the bag as collapsed now fits inside the bottom portion in a kind of a cup within another cup structure, such that the two panels which were formerly on the opposite outer sides of the bag as collapsed, now touch each other in the extended configuration of the duffle.

Figure 32:
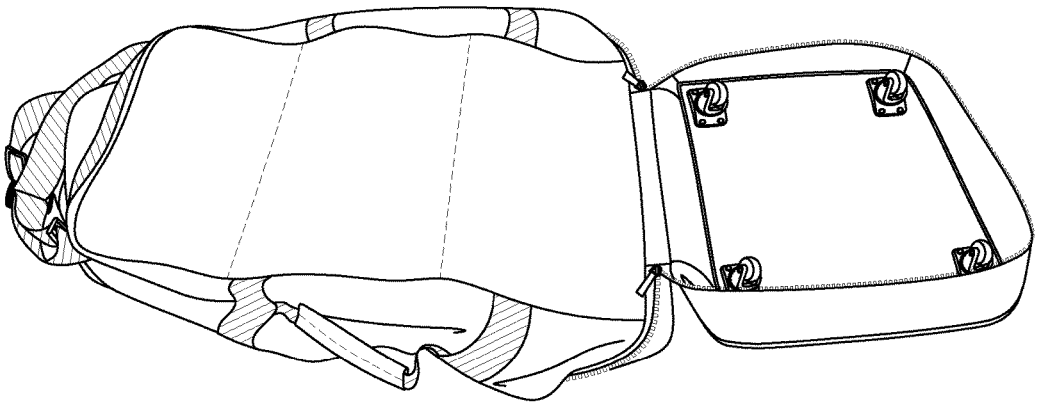
Figure 33:
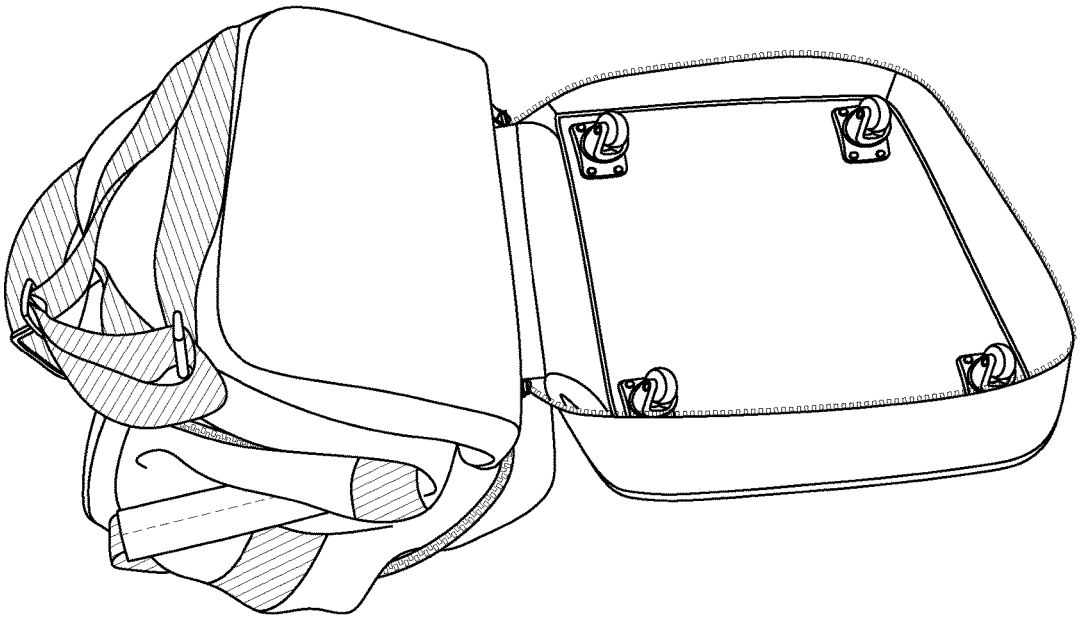
Figure 34:
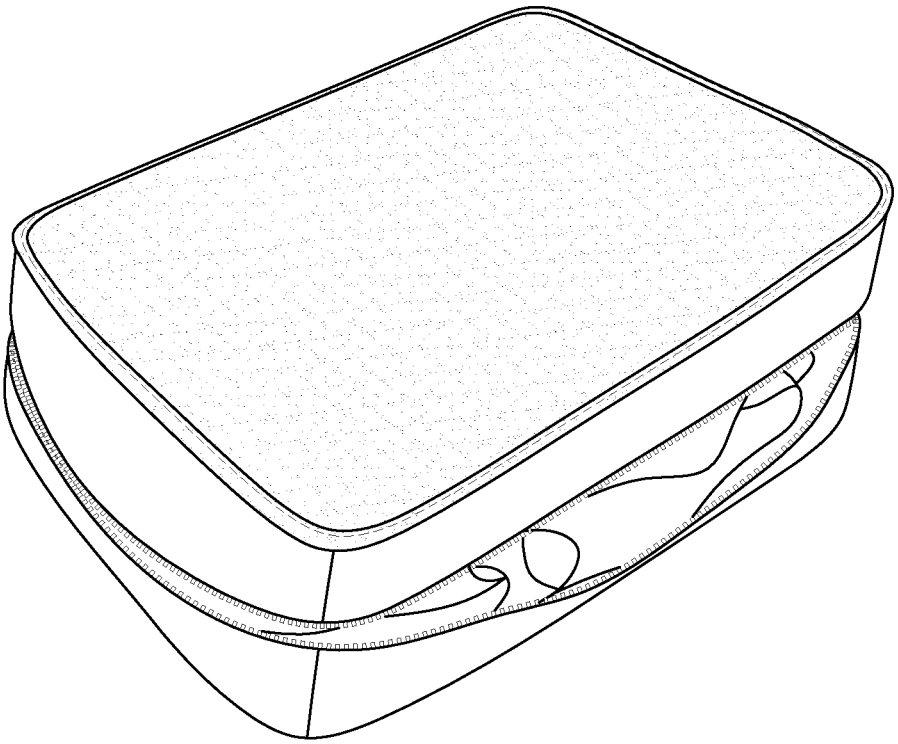
Figure 35:
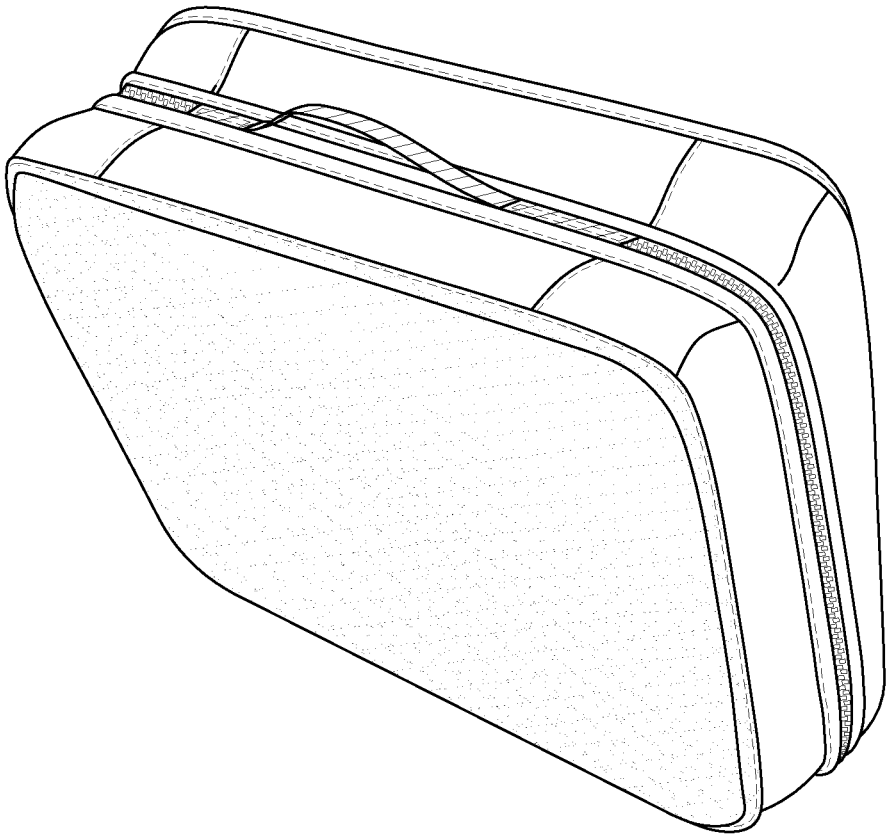

FIG. 32 illustrates a re-collapsing process of the bag which ultimately ends in the configuration shown in FIG. 15. Here in FIG. 32 the bag has been turned so that its rear portion is upwards and the bottom portion has been flipped so that the wheels now point to the interior of the bag in contrast to the configuration shown in FIG. 31 where they point outwards from, and to the exterior of the bag. From the configuration of FIG. 32 the upper portion of the bag will need to be folded on itself such that it fits within the lower (rigid) portion of the upper portion of the duffle and so that those two can then be folded together to reach the configuration shown in FIG. 15. This process is shown continuing in FIG. 33, where essentially the upper portion of the bag—which was totally spread out in FIG. 32—has now been folded on itself in a kind of three panel fold so that it can fit inside of the lower part of the upper portion as shown and folded over to sit on top of the bottom portion where the wheels are held, as shown in FIG. 34. Once the configuration as shown in FIG. 34 has been zipped, for example, then the bag assumes the configuration of FIG. 35 which is identical to that shown in FIG. 15.

Exemplary One Rigid Panel Embodiment

Figure 36:
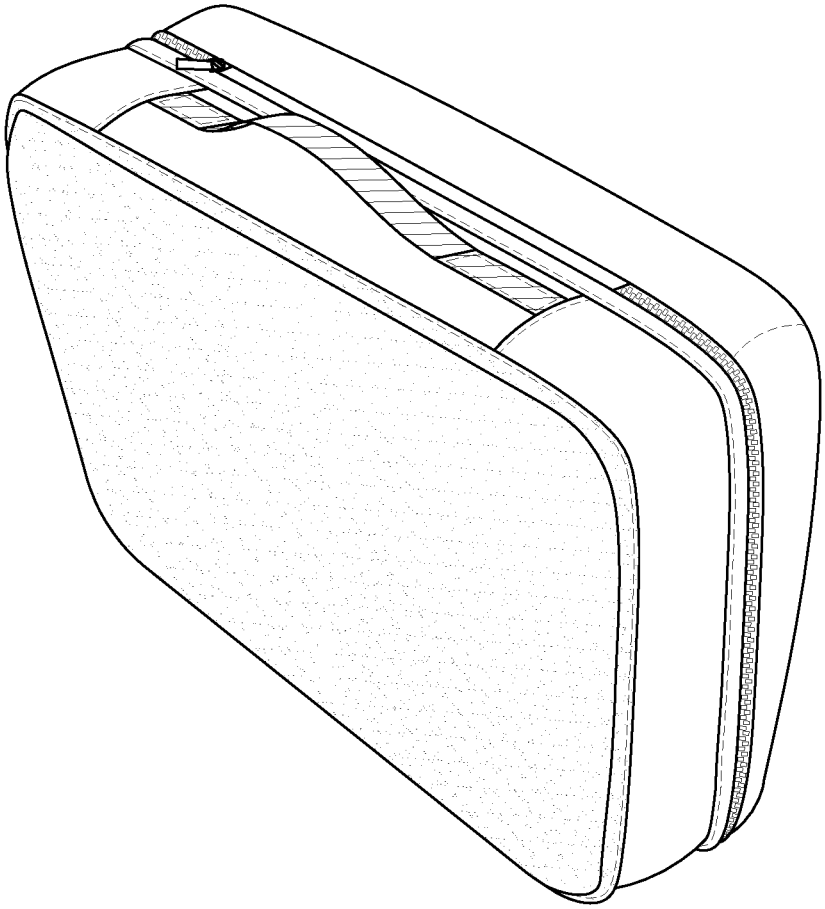
Figure 37:
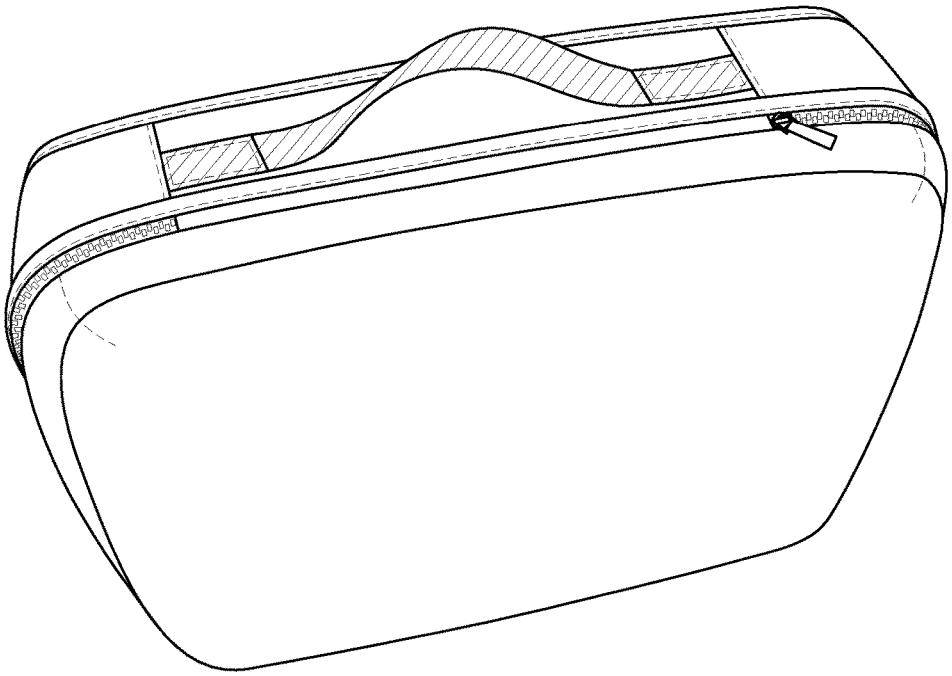

FIGS. 36-54, next described, refer to the blue colored exemplary foldable duffle, as shown in FIGS. 16 and 17, and as also shown schematically in FIGS. 10-13. FIGS. 36 and 37 are front and rear views, respectively, of the exemplary single rigid panel foldable duffle according to exemplary embodiments of the present invention. FIGS. 36 and 37 are views of the fully collapsed and zipped up configuration of the same article, where the duffle can be carried as a small attaché case.

Figure 38:
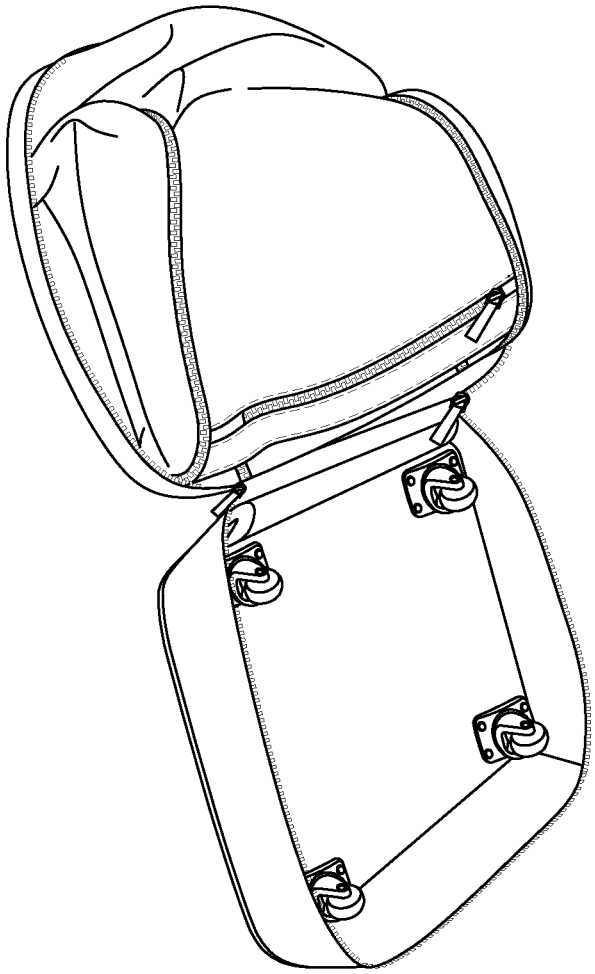

FIG. 38 illustrates the beginning of an unfolding or expansion phase for the exemplary foldable duffle of FIGS. 36 and 37. Here the duffle's horizontal zipper has been unzipped, but otherwise the article is unchanged. Therefore, in the top half of FIG. 38 one can see the entire upper portion of the duffle folded or rolled on itself sitting within the bottom part of the upper portion; in the bottom half of FIG. 38 one can see the bottom portion of the foldable duffle turned inside out such that the wheels protrude inwardly toward the cavity of the collapsed duffle.

Figure 39:
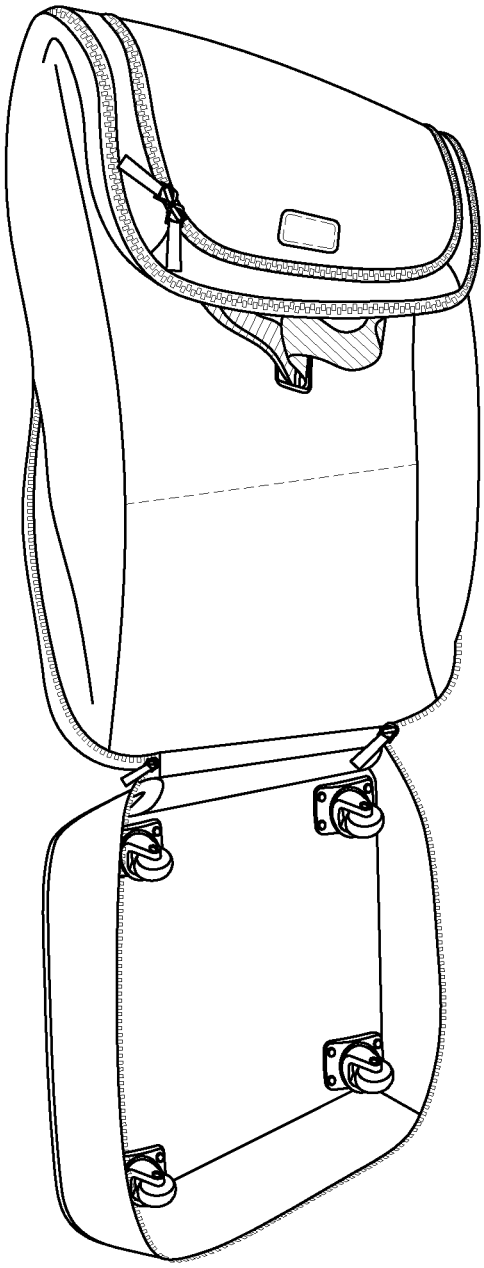
Figure 40:
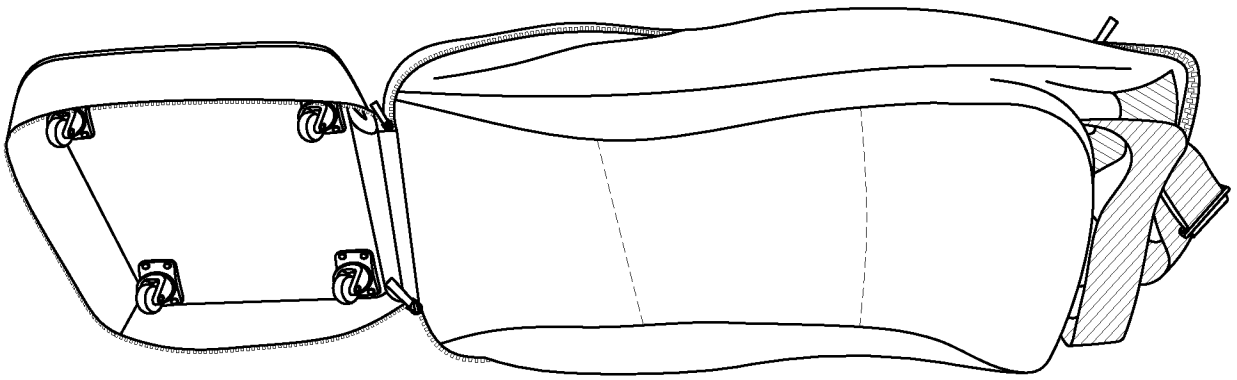
Figure 41:
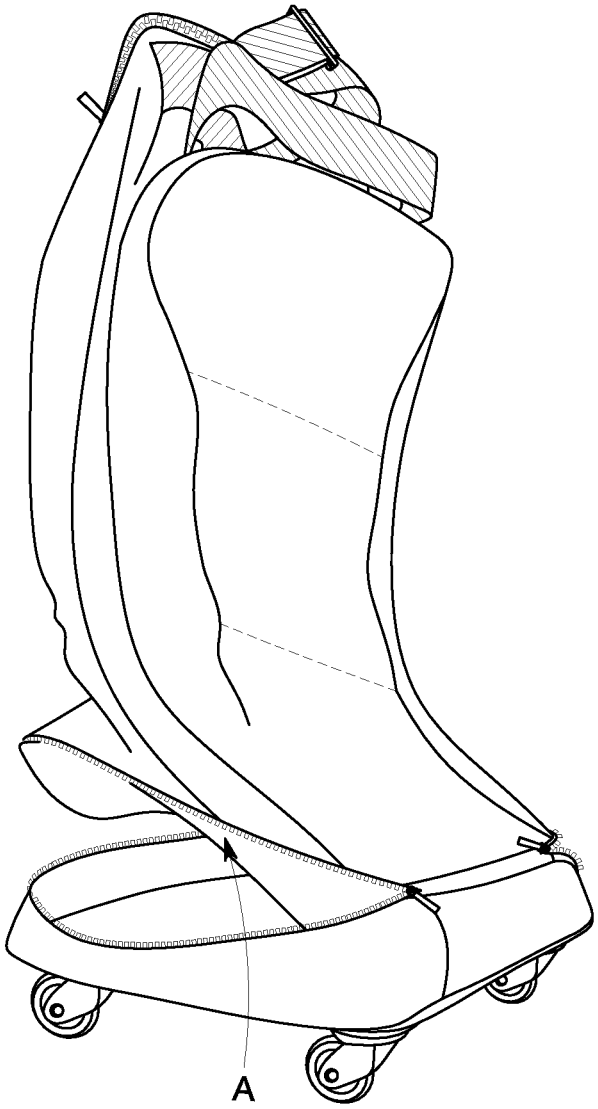
Figure 42:
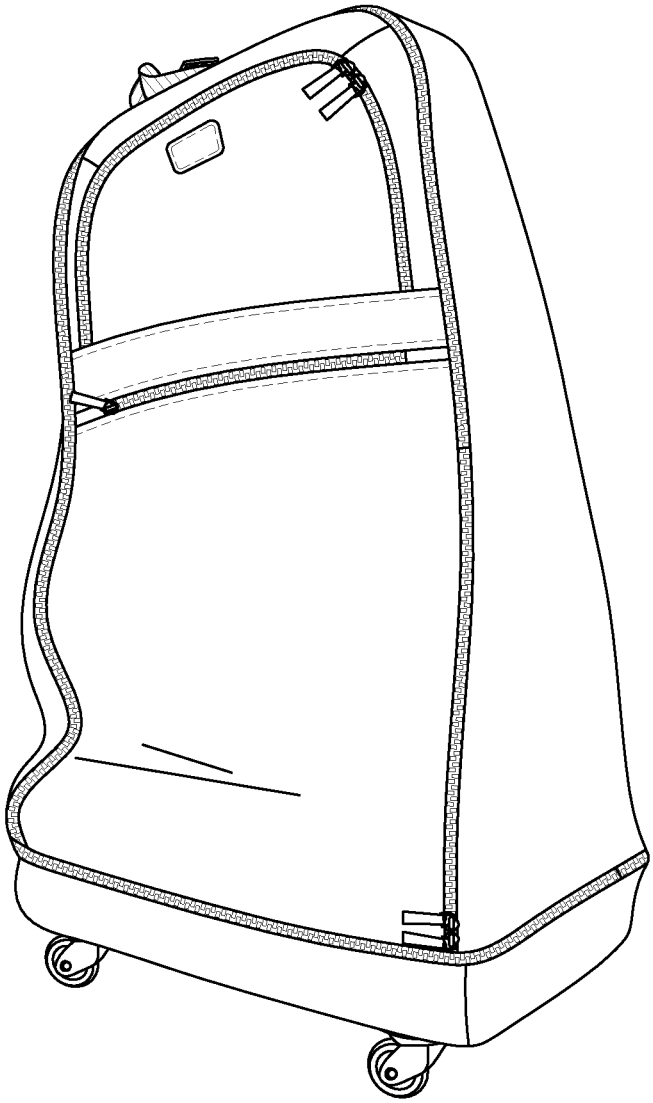
Figure 43:
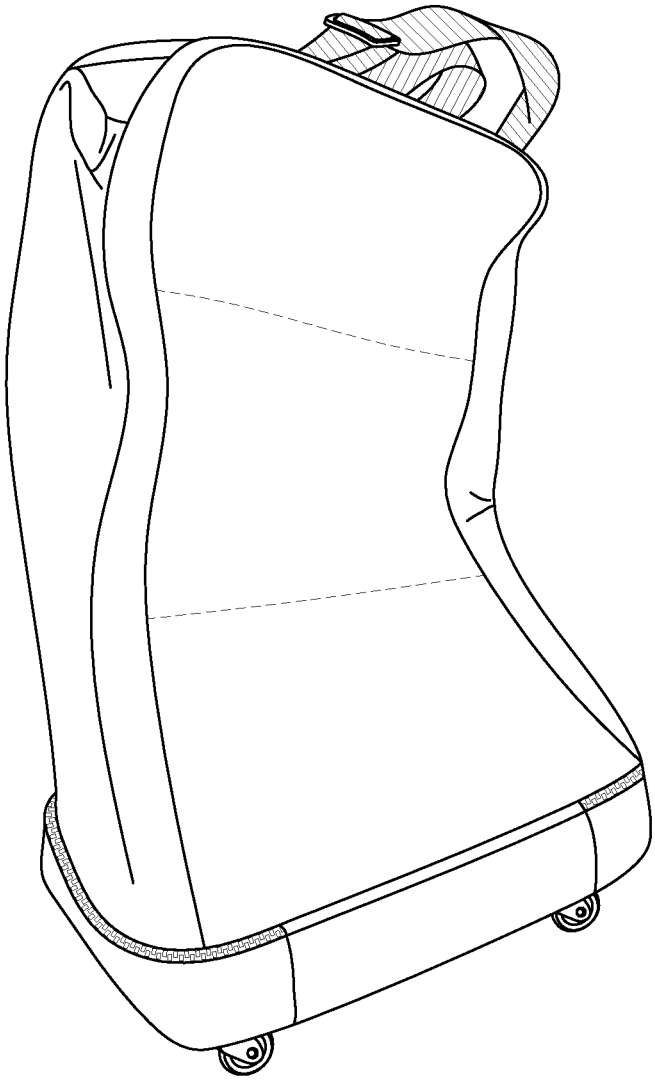

FIG. 39 shows the upper portion now being unfolded and unrolled but the bottom portion is still in its reverse wheels-in state. FIG. 40 shows the completion of the unfolding of the upper portion of the duffle. FIG. 41 shows the bottom portion now reversed so that the wheels protrude from the bottom panel in the normal expanded configuration, and the band/ring of cloth which comprised the walls of the bottom portion of the duffle in the collapsed state now points upwards and lies above the plane of the bottom plate from which the wheels protrude. All that remains here is to zip the bottom portion of the duffle to the bottom part of the upper portion of the duffle, resulting in the configuration of FIG. 42 resulting in the expanded state. FIG. 43 is a rear view of FIG. 42.

Figure 44:
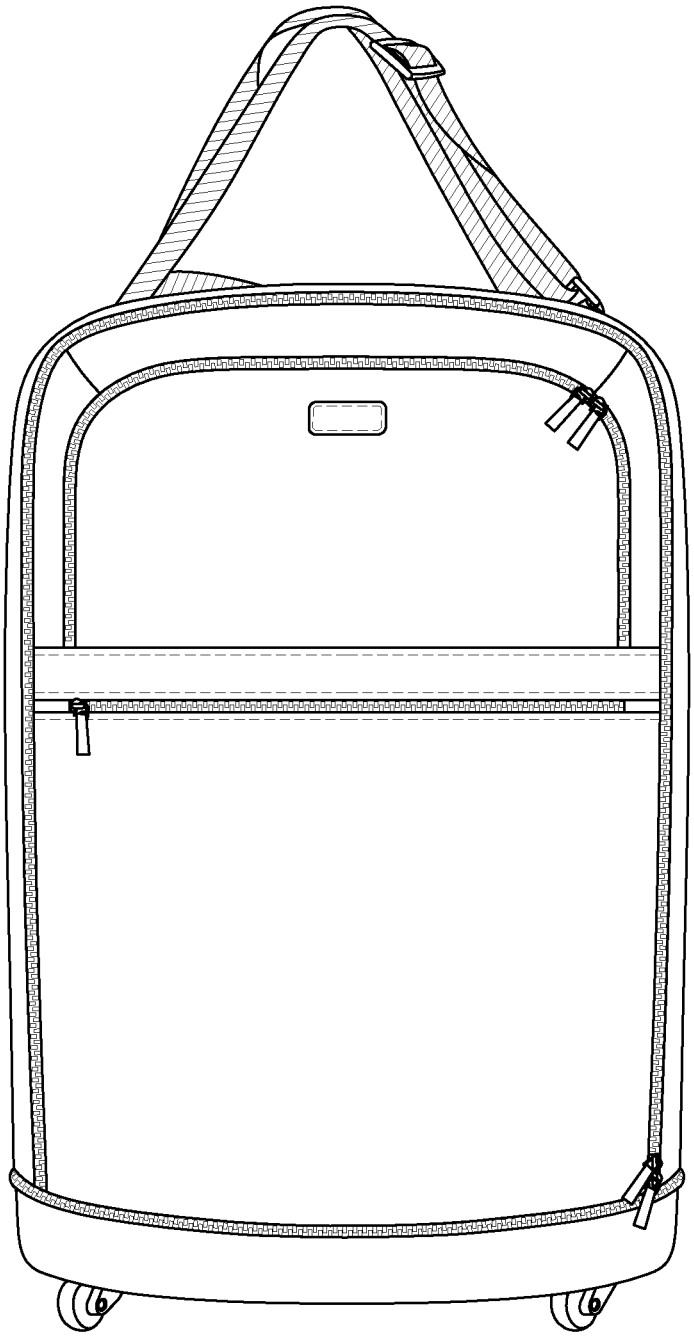
Figure 45:
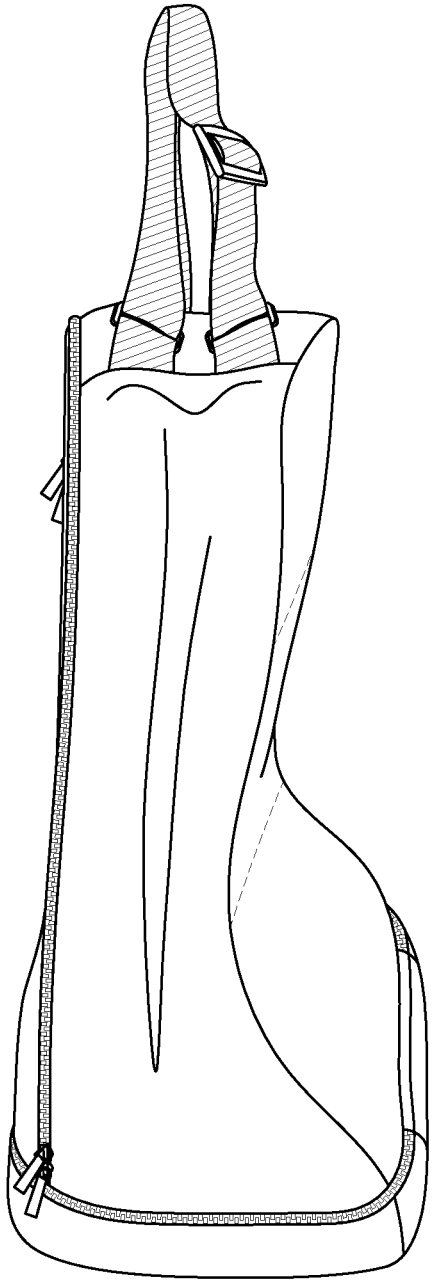
Figure 46:
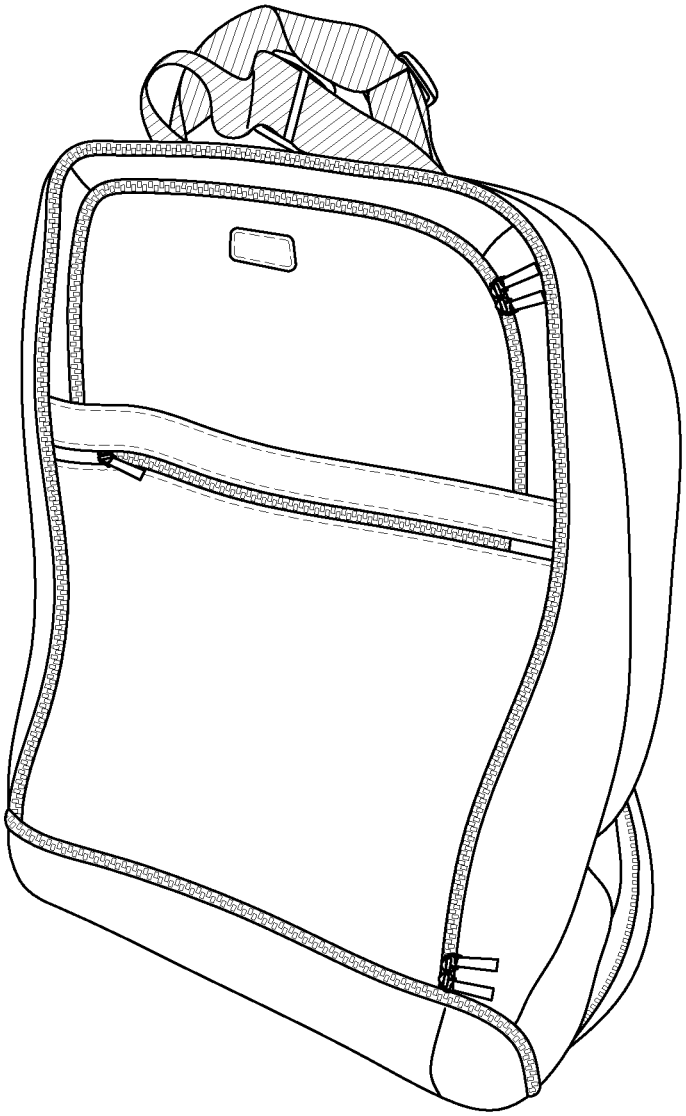

FIG. 44 shows a user pulling the duffle to its full extendable vertical state by pulling on the handles provided on top. FIG. 45 is a side view of the top as seen in FIG. 44, showing the two handles and the extended—but otherwise collapsed—volume of the duffle. FIG. 46 shows once again the view of FIG. 44 in what is now the beginning of a re-collapsing sequence of images. These are presented so that it can be easily appreciated how the foldable duffle is re-collapsed to the fully collapsed state. Therefore, as seen in FIG. 47 the bottom portion of the foldable duffle is totally unzipped from the top, only being connected by the portion of the perimeter which is not zipable (i.e., the swath of cloth or other material that functions as a hinge between the upper and lower portions of the article) and this is the portion that connects the bottom portion and the upper portion of the duffle so that the bottom portion can swing between both of its configurations.

Figure 47:
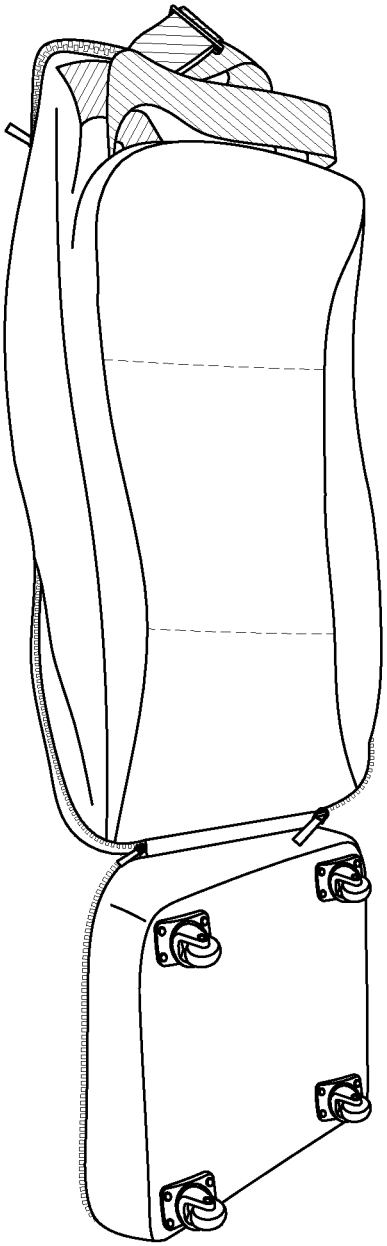
Figure 48:
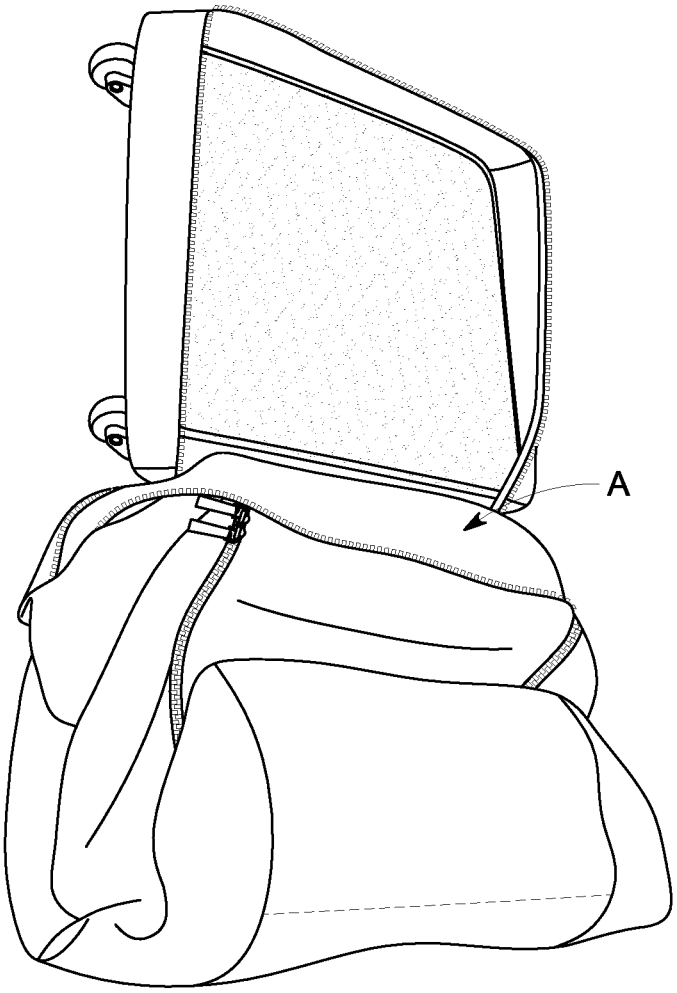

FIG. 48 shows the same view as in FIG. 47; however, now the top portion has been rolled on itself and the bottom portion has been flipped over in preparation for flipping the cloth band so that it can encompass the wheels which will point to the interior of the bag. The reversing of the wheels as accomplished is shown in FIG. 49, which is the configuration of FIG. 48 flipped over, where the band of fabric is now reversed and encompassing/containing the wheels.

Figure 49:
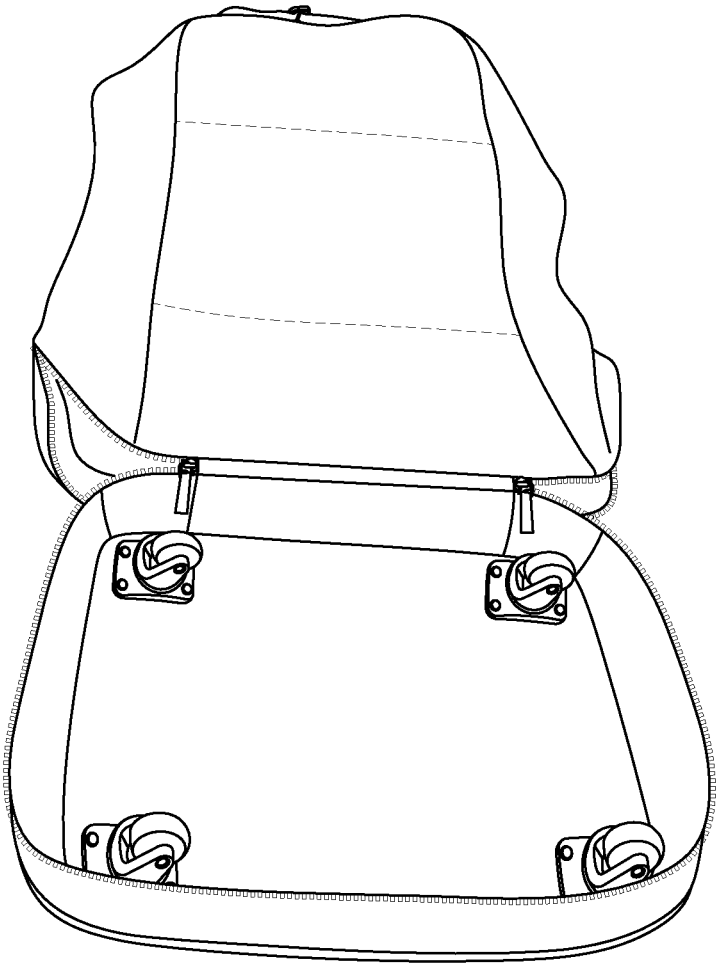
Figure 50:
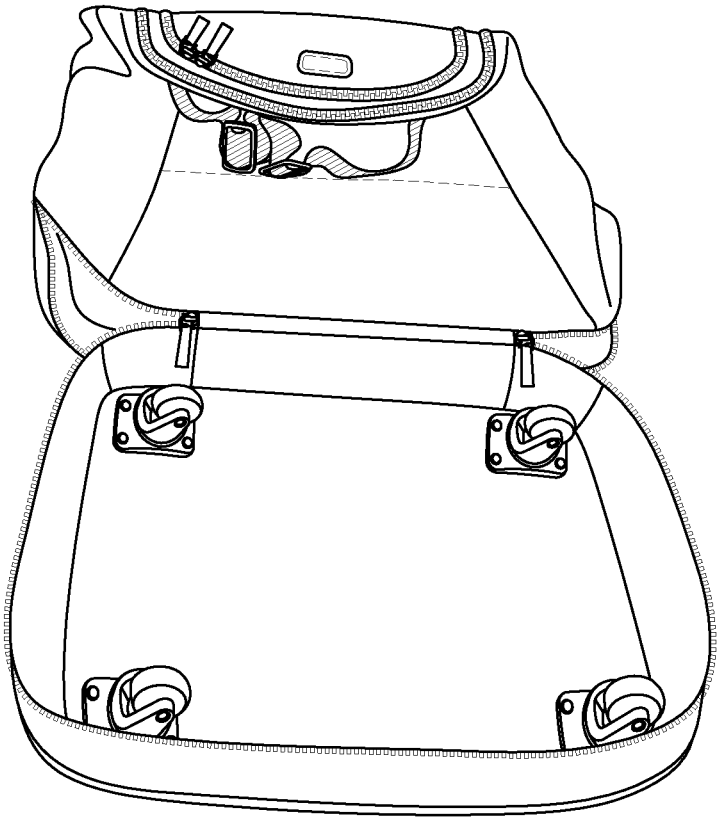
Figure 51:
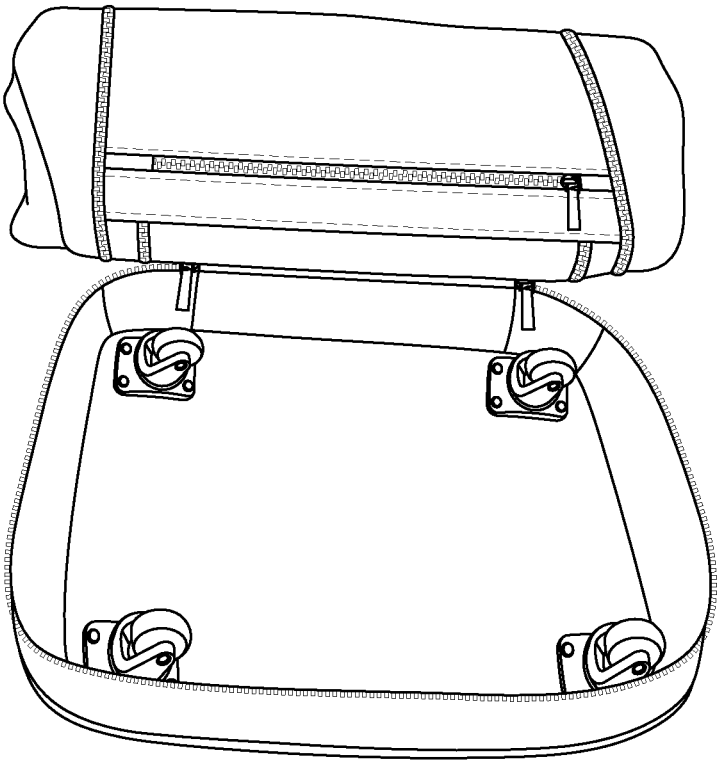
Figure 52:
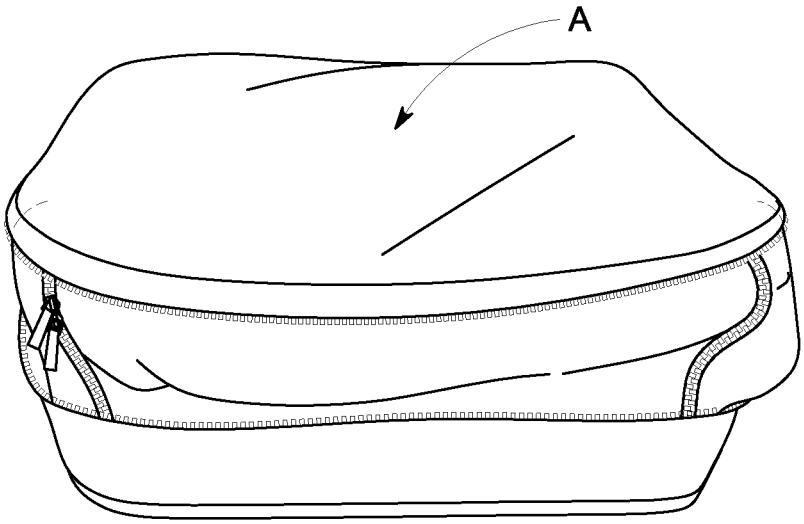
Figure 53:
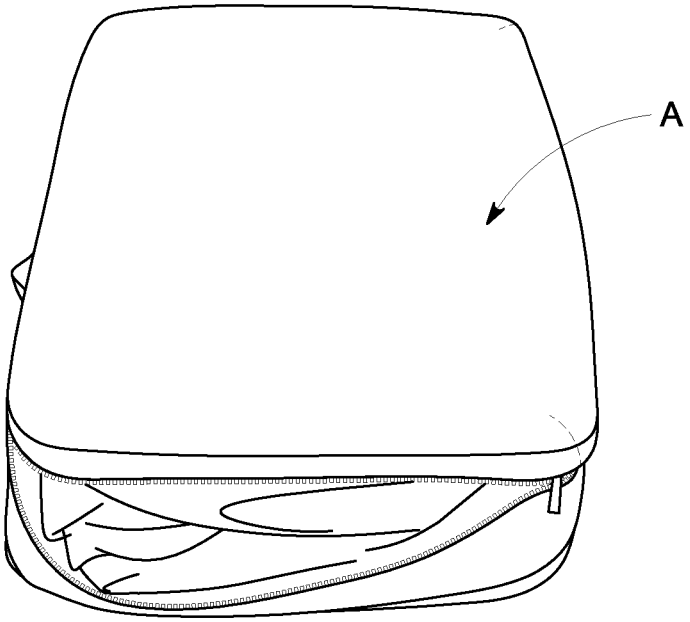

FIG. 50 shows the same configuration shown in FIG. 49 but now the upper portion of the duffle is beginning to be folded on itself. This process is completed as shown in FIG. 51 where the upper portion of the duffle has been totally rolled upon itself. FIG. 52 shows that rolled up portion of the upper duffle now folded over so that it covers the bottom portion holding the wheels, and FIG. 53 shows the zippering of the configuration shown in FIG. 52, but in a side view. And finally, FIG. 54 shows the entire collapsible bag zippered and presented as an easy attaché type case.

Figure 54:
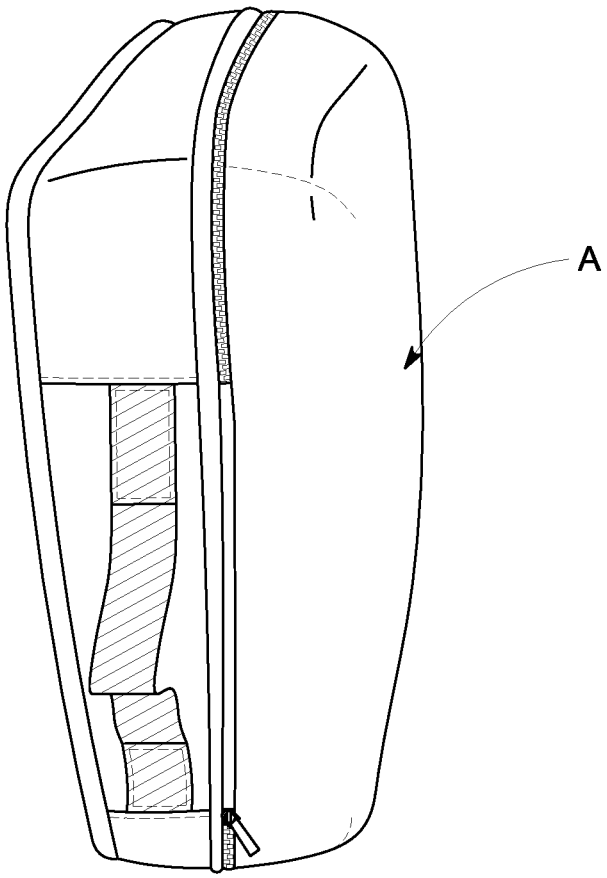

As noted in FIG. 54, one can clearly see—on the left side of the image—the bottom portion of the foldable duffle, which contains the handle and the semi-rigid plane (effected through padding, mesh, honeycomb, piping of wire or other material around the perimeter, etc., as noted above). On the right side of the image in FIG. 54 is the soft surface with no piping, padding or reinforcing, which contains the rolled up upper portion of the duffle within it. The surface now seen as an outer surface at the right side of FIG. 54 is an interior piece of cloth or other material that rests inside the bottom portion of the upper portion of the duffle when it is in its expanded state, as shown, for example, in FIG. 41, where on the bottom or underside of the upper portion of the duffle is that same surface now seen as the outer surface in the right side of FIG. 54. This surface is labeled A and indicated by the arrow in FIGS. 41, 48, 52 and 54 for easy tracking visually of where the surface is at various stages in expanding and collapsing.

The above-presented description, figures and photographs are intended by way of example only and are not intended to limit the present invention in any way except as set forth in the following claims. It is particularly noted that the persons skilled in the art can readily combine the various technical aspects of the various elements of the various exemplary embodiments that have been exemplarily described above in numerous other ways, all of which are considered to be within the scope of the invention. For example, any method of strengthening a rigid panel or panels may be used, various numbers of wheels maybe used, various materials can be used for the hinge between the upper and lower portions of a duffle can be used, and any material, affixation device or system described in connection with one exemplary embodiment is understood to be compatible with any other, etc. Various features provided in the various applications to which priority is claimed herein and which are incorporated by reference are all understood as available to be used with any exemplary embodiment of the present invention, as may be useful or desired.

What is claimed is:

1. A collapsible article of luggage, comprising:

a bottom portion comprising a first semi-rigid or rigid panel connected along its perimeter to a first band of flexible material on a first end of said band, a plurality of wheels attached to an underside of said first semi-rigid or rigid panel;

an upper portion comprising a second rigid or semi-rigid panel connected along its perimeter to a second band of flexible material on a first end of said band;

a releasable connection, connecting the first band of flexible material via a zipper to the second band of flexible material on three sides and connected, via a non-releasable connection, on at least a portion of a fourth side, the bands of flexible material being so connected on their respective second ends, wherein, in its expanded state, the second panel and the second band of flexible material fit inside the first panel and the first band of flexible material, such that the second panel rests on top of the first panel, on the side opposite the side of the first panel to which the wheels are attached.

2. The article of claim 1, wherein in a collapsing operation the first panel is turned upside down by rotating it 180 degrees about the non-releasable connection.

3. The article of claim 1, wherein there is further provided on the interior side of the non-releasable connection a handle, such that it is contained within the article in an expanded state, and visible on the upper exterior of the article in a collapsed state.

4. The article of claim 1, wherein in an expanded state the article is oriented vertically, and provided with handles on top of its upper portion.

5. The article of claim 1, wherein the non-releasable connection functions as a hinge between the first band of flexible material and the second band of flexible material.

6. The article of claim 5, wherein the non-releasable connection comprises one of:

a same material as used in the upper portion and the lower portion, a same material as used in the upper portion and the lower portion at least one of strengthened or reinforced, or a different material than that used in the upper portion and the lower portion.

7. The article of claim 1, wherein at least one of the first semi-rigid or rigid panel and the second semi-rigid or rigid panel is reinforced with at least one of padding, thicker material, a mesh structure, a honeycomb structure, and a frame along its perimeter.

8. The article of claim 7, wherein the frame is made from one or more of wire, carbon fibers, and dowels.

9. The article of claim 1, wherein, in a collapsing operation, the bottom portion is partially separated from the upper portion by releasing the releasable connection between said first semi-rigid or rigid panel and said second semi-rigid or rigid panel, the first panel is turned upside down and the first band of flexible material is turned inside out so that it surrounds the plurality of wheels, the upper portion is one of folded and rolled up so as to fit within the second band of flexible material, and the releasable connection is reconnected such that the wheels and the entire portion are enclosed in a volume defined between the first and second panels and the first and second bands of flexible material.

10. A method of providing a foldable article of luggage, comprising:

providing a bottom portion comprising a first semi-rigid or rigid panel connected along its perimeter to a first band of flexible material on a first end of said band, a plurality of wheels attached to an underside of said first semi-rigid or rigid panel;

providing an upper portion comprising a second panel connected along its perimeter to a second band of flexible material on a first end of said band;

releasably connecting, via a zipper, a releasable connection between the first band of flexible material and the second band of flexible material on three sides, and connecting said first and second bands non-releasably on at least a portion of a fourth side, the bands of flexible material being so connected on their respective second ends, such that, in an expanded state, the second panel and second band of flexible material fit inside the first panel and first band of flexible material, such that the second panel rests on top of the first panel, on the side opposite the side of the first panel to which the wheels are attached.

11. The method of claim 10, wherein the second panel of the upper portion is one of rigid, semi-rigid or non-rigid.

12. The method of claim 10, wherein, in a collapsing operation, the bottom portion is partially separated from the upper portion by releasing the releasable connection between said first semi-rigid or rigid panel and said second panel, the first panel is turned upside down and the first band of flexible material is turned inside out so that it surrounds the plurality of wheels, the upper portion is one of folded and rolled up so as to fit within the second band of flexible material, and the releasable connection is reconnected such that the wheels and the entire portion are enclosed in a volume defined between the first and second panels and the first and second bands of flexible material.

* * * * *